US011259602B1

(12) United States Patent
Padula

(10) Patent No.: US 11,259,602 B1
(45) Date of Patent: Mar. 1, 2022

(54) ARTICLE RETENTION APPARATUS

(71) Applicant: Desiree Coleen Padula, Denver, CO (US)

(72) Inventor: Desiree Coleen Padula, Denver, CO (US)

( * ) Notice: Subject to any disclaimer, the term of this patent is extended or adjusted under 35 U.S.C. 154(b) by 0 days.

(21) Appl. No.: 17/502,831

(22) Filed: Oct. 15, 2021

Related U.S. Application Data

(60) Provisional application No. 63/091,928, filed on Oct. 15, 2020.

(51) Int. Cl.
*A44B 6/00* (2006.01)

(52) U.S. Cl.
CPC ..... *A44B 6/00* (2013.01)

(58) Field of Classification Search
CPC ..... A44B 6/00; A41D 25/025; A41D 25/027; Y10T 24/394; Y10T 24/3938; Y10T 24/3936; Y10T 24/3944
See application file for complete search history.

(56) References Cited

U.S. PATENT DOCUMENTS 3,745,614 A * 7/1973 Tsang ..... A41D 25/022 2/148
5,630,259 A * 5/1997 Ricketts ..... A44B 6/00 24/300
6,782,588 B1 * 8/2004 Liu ..... A43C 7/08 24/134 KB
6,904,613 B2 * 6/2005 Dotterer ..... A41D 25/06 2/156

FOREIGN PATENT DOCUMENTS

WO WO-2021005427 A1 * 1/2021 ..... A44B 6/00

* cited by examiner

*Primary Examiner* — Robert Sandy
(74) *Attorney, Agent, or Firm* — Roger A. Jackson

(57) ABSTRACT

An article retention apparatus adapted to retain an article in a loop, the article retention apparatus includes a surrounding sidewall having a first end portion and an opposing second end portion, also an aperture disposed therethrough the surrounding sidewall. Also included is a chain having a proximal end portion and an opposing distal end portion, wherein the chain is partially disposed therethrough the aperture, the chain is positioned such that the chain proximal end portion disposed within a surrounding sidewall interior and the chain distal end portion is adjacent to a surrounding sidewall outer surface and an ornamental element affixed to the chain distal end portion. Further included is a friction head affixed to the chain proximal end portion, the friction head projects into the surrounding sidewall interior and retains the chain within the aperture and compresses the article that is threaded therethrough the interior of the surrounding sidewall.

14 Claims, 25 Drawing Sheets

ARTICLE RETENTION APPARATUS

RELATED APPLICATION

This application claims the benefit of U.S. provisional patent application Ser. No. 63/091,928 filed on Oct. 15, 2020 by Desiree Coleen Padula of Denver, Colo., U.S.

TECHNICAL FIELD

The present invention generally relates to an article retention apparatus to hold two ends of an article in position to one another. More particularly, the present invention is a scarf/necklace holder with an optional friction inducing inner mechanism to better hold the scarf/necklace in place plus an option for decorative items to be placed on the outside of the scarf/necklace holder.

BACKGROUND OF INVENTION

The present invention is associated with clothing accessories, most notably a scarf that is worn around an individuals neck sometimes for warmth and sometimes for adornment, of course scarfs can be manually tied about the wearer's neck, however, a cleaner way to retain the scarf is with a specific item designed for holding a scarf being a scarf retainer, plus as a bonus the scarf retainer can have added ornamental adornments of various types that can be optionally added to the scarf retainer.

A further desirable feature of the scarf retainer would be a way to help retain the scarf in a more secure manner within the scarf retainer that would be easy to use, such that not requiring anything to be taken apart or put together to use the scarf retainer.

Looking at the prior art in U.S. Pat. No. 9,936,748 to Pinto, disclosed is a scarf holder that is cylindrical in shape wherein the scarf is disposed therethrough, the cylindrical shape having first and second fasteners respectively attached to first and second ends, wherein the first and second fasteners are removably engageable to one another as the cylindrical shape is flexible and has an open state and a closed state, see FIGS. 3, 4, and 6 for the open state and FIGS. 7 and 8 for the closed state. The flexible cylindrical shape is comprised of a plurality of arcuate members in a stacked configuration.

Continuing in the prior art in U.S. Pat. No. 10,687,587 to Tran, disclosed is a scarf holder that is formed from a loop of an elastic material with a decorative plate slidably engaged to the loop, wherein the slidable engagement uses curved hoop sets of at least three in number (similar to a fishing pole eyelet), further the loop of elastic material can be partially encased with decorative stones or beads.

There remains a need for having a scarf/necklace retainer that does not require opening or closing, or any separate parts to put together or take apart, desirably the scarf/necklace retainer would be a simple slip on and slip off affair with the scarf or necklace, being especially useful for user's who have poor eyesight, arthritis, dexterity problems, and so on, wherein the position of the decorative element would be easy to find on the outside of the scarf/necklace retainer for the user to face the decorative item properly forward, in addition by virtue of gravity the flexible element holding the decorative element to the scarf/necklace retainer will face downward when worn by the user.

SUMMARY OF INVENTION

Broadly, the present invention is of an article retention apparatus adapted to retain the article in a loop, wherein the article is in an elongated shape having two free ends, the article retention apparatus includes a surrounding sidewall about a longitudinal axis, the surrounding sidewall having a first end portion and an opposing second end portion with the longitudinal axis spanning therebetween, the surrounding sidewall having an outer surface and an opposing inner surface that defines a surrounding sidewall interior. Further included in the article retention apparatus is an aperture disposed therethrough the surrounding sidewall from the outer surface to the inner surface, the aperture having an aperture largest dimension.

Also included in the article retention apparatus is a flexible element having a proximal end portion and an opposing distal end portion, wherein the flexible element is partially disposed therethrough the aperture, the flexible element is positioned such that the flexible element proximal end portion disposed within the surrounding sidewall interior and the flexible element distal end portion is adjacent to the surrounding sidewall outer surface and an ornamental element affixed to the flexible element distal end portion.

Further included in the article retention apparatus is a friction head affixed to the flexible element proximal end portion, the friction head having a maximum dimension that is greater than the aperture largest dimension, the friction head projects into the surrounding sidewall interior and operationally accomplishes two functions, a first function is to retain the flexible element within the aperture and a second function is to compress the two free ends of the article that are threaded therethrough the interior of the surrounding sidewall to add friction to the free ends of the article to further help retain the article two free ends to be adjacent to one another via the article retention apparatus.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 3 is view 3-3 from FIG. 2, wherein FIG. 3 shows the second end portion view of the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior;

FIG. 4 is view 4-4 from FIGS. 5 and 6, wherein FIG. 4 is the FIG. 3 view with the addition of the article including two free ends of the article shown, wherein FIG. 4 also shows the second end portion view of the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element also shown is the friction head projecting into the surrounding sidewall interior, wherein the friction head compresses the two free ends of the article that are threaded therethrough the interior of the surrounding sidewall;

FIG. 12 is view 12-12 from FIG. 11, wherein FIG. 12 shows the second end portion view of the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior;

FIG. 13 is view 13-13 from FIGS. 15, 16, and 17, wherein FIG. 13 is the FIG. 12 view with the addition of the article, FIG. 13 also shows the second end portion view of the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior, wherein the friction head compresses the article that is threaded therethrough the interior of the surrounding sidewall;

FIG. 14 is view 14-14 from FIGS. 15, 16, and 17, wherein FIG. 14 is the FIG. 12 view with the addition of the article including two runs of the article shown, wherein FIG. 14 also shows the second end portion view of the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior, wherein the friction head compresses the two free ends of the article that are threaded therethrough the interior of the surrounding sidewall;

FIG. 22 is view 22-22 from FIG. 21, wherein FIG. 22 shows the surrounding sidewall worn by the user in a lateral positional orientation with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior, wherein the article free ends are threaded therethrough the interior of the surrounding sidewall;

FIG. 23 is view 23-23 from FIG. 24, wherein FIG. 23 shows the surrounding sidewall worn by the user in a lateral positional orientation with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior, wherein the article is threaded therethrough the interior of the surrounding sidewall;

FIG. 25 shows a vertical cross section view of FIG. 23 with the friction head rotated into view for clarity, wherein FIG. 25 shows the surrounding sidewall with the inner and outer surfaces, the surrounding sidewall interior, the aperture, the flexible element with the proximal and distal end portions of the flexible element with the ornamental element disposed on a distal end portion of the flexible element and the flexible element disposed therethrough the aperture with a friction head attached to the proximal end portion of the flexible element, also shown is the friction head projecting into the surrounding sidewall interior.

REFERENCE NUMBERS IN DRAWINGS

50 Article retention apparatus

Figure 1:
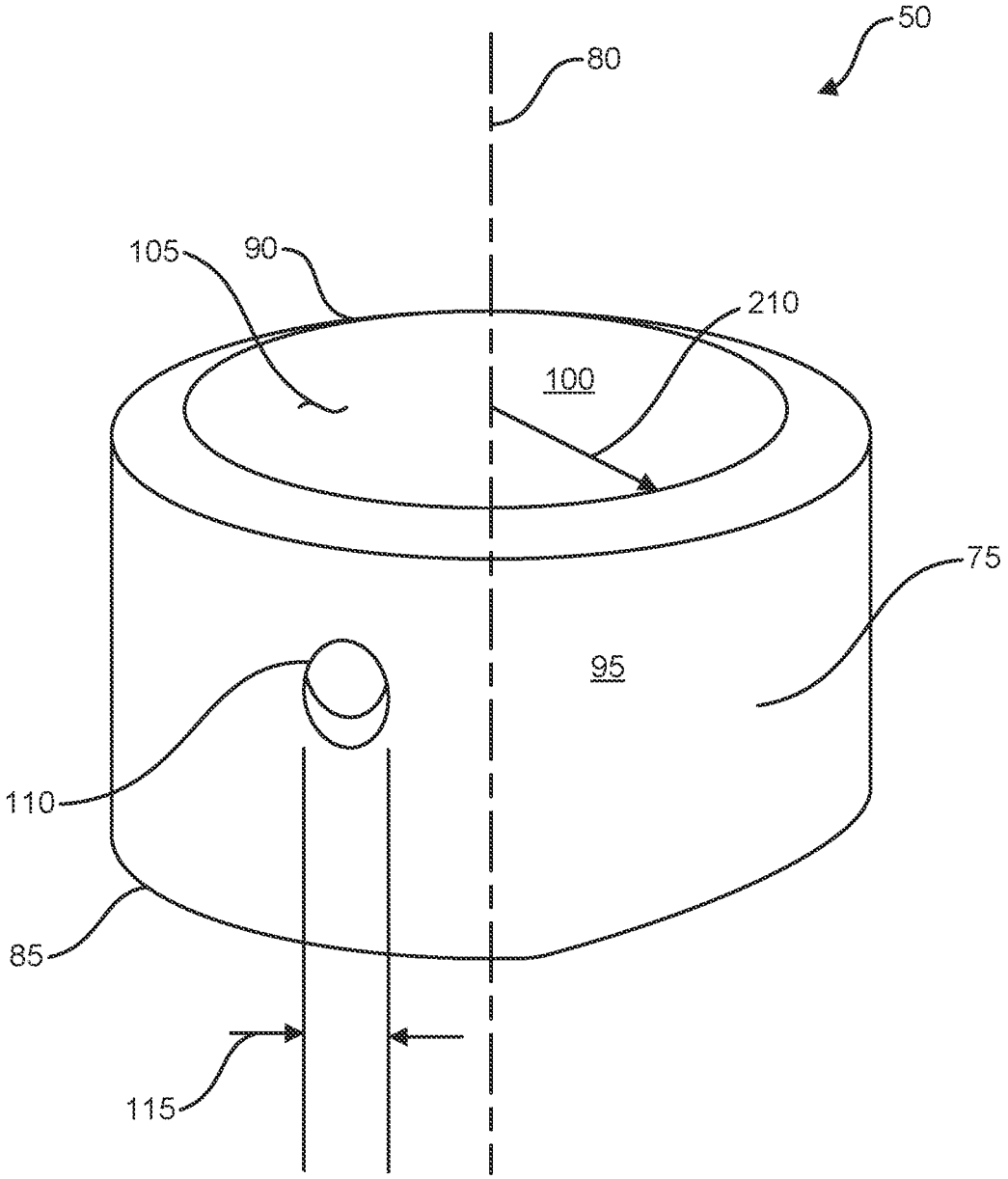
FIG. 1 shows an upper perspective view of the article retention apparatus that includes a surrounding sidewall that is about a longitudinal axis, the inner and outer surfaces of the surrounding sidewall, the surrounding sidewall interior, and the first and second end portions of the surrounding sidewall with the aperture shown.

55 Article which can be a scarf that has either two free ends that are folded or separate that are both fed therethrough the article retention apparatus 50 in the putting on direction 56 or the scarf can also be a continuous loop with no free ends that is folded and fed therethrough the article retention apparatus 50 in the putting on direction 56

56 Putting on directional movement of the article 55

57 Removing directional movement of the article 55

60 Loop of the article 55

65 Elongated shape of the article 55

70 Two free ends of the article 55

75 Surrounding sidewall

80 Longitudinal axis of the surrounding sidewall 75

85 First end portion of the surrounding sidewall 75

90 Second end portion of the surrounding sidewall 75

95 Outer surface of the surrounding sidewall 75

100 Inner surface of the surrounding sidewall 75

105 Interior of the surrounding sidewall 75

110 Aperture of the surrounding sidewall 75

115 Largest dimension of the aperture 110

120 Flexible element that can be in the form of a chain or a suitable equivalent

125 Proximal end portion of the flexible element 120

130 Distal end portion of the flexible element 120

135 Flexible element 120 partially disposed within the aperture 110, 355

140 Ornamental element

145 Friction head

146 First plane of the friction head 145

150 Affixed nature of the friction head 145 to the proximal end portion 125 of the flexible element 120

155 Maximum dimension of the friction head 145

160 Projection of the friction head 145 into the interior 105, 360 of the surrounding sidewall 75, 330

165 Compress of the two free ends 70 of the article 55 that are threaded therethrough the interior 105 of the surrounding sidewall 75

170 Plurality of flexible elements 120 that can include a plurality of ornamental elements 140

175 User of the article 55, 300

200 Projection distance into surrounding sidewall 75, 330 interior 105, 360 of the friction head 145

210 First radius of the inner surface 100 of the surrounding sidewall 75

220 Second radius of the friction head 145

225 Third distance of the friction head 145

226 Third surface of the friction head 145

227 Third free space area

230 Pivotal bearing tangential contact between the first 210 and second 220 radii on the surrounding sidewall 75, 330 inner surface 100, 355

231 Moving pivotal bearing tangential contact 230 between the first 210, 380 and second 220 radii along the surrounding sidewall 75, 330 inner surface 100, 355

240 Second surface of the friction head 145

250 Projection surface of the friction head 145

260 First free movement of the first plane 146

270 Parallel position of the first plane 146 to the longitudinal axis 80, 335

280 Perpendicular position of the first plane 146 to the longitudinal axis 80, 335

300 Alternate article that can include having the form of a necklace, jewelry chain, cord, beads, leather, cable, segmented smooth chain, semi-smooth segmented chain bead, omega, box, herringbone, snake, continuous coil, fiber knots, wire rope, or equivalent

305 Putting on directional movement of the article 300

310 Removing directional movement of the article 300
315 Loop of the article 300
320 Elongated shape of the article 300
325 Two free ends of the article 300
330 Surrounding sidewall of the alternate embodiment
335 Longitudinal axis of surrounding sidewall 330
340 First end portion of the surrounding sidewall 330
345 Second end portion of the surrounding sidewall 330
350 Outer surface of the surrounding sidewall 330
355 Inner surface of the surrounding sidewall 330
360 Interior of the surrounding sidewall 330
365 Aperture of the surrounding sidewall 330
370 Largest dimension of the aperture 365
375 Compress of the two free ends 325 of the article 300 that are threaded therethrough the interior 360 of the surrounding sidewall 330
380 First radius of the inner surface 355 of the surrounding sidewall 330

DETAILED DESCRIPTION

With initial reference to FIG. 1 shown is the upper perspective view of the article retention apparatus 50 that includes a surrounding sidewall 75 that is about a longitudinal axis 80, the inner 100 and outer 95 surfaces of the surrounding sidewall 75, the surrounding sidewall interior 105, and the first 85 and second 90 end portions of the surrounding sidewall 75 with the aperture 110 shown.

Figure 2:
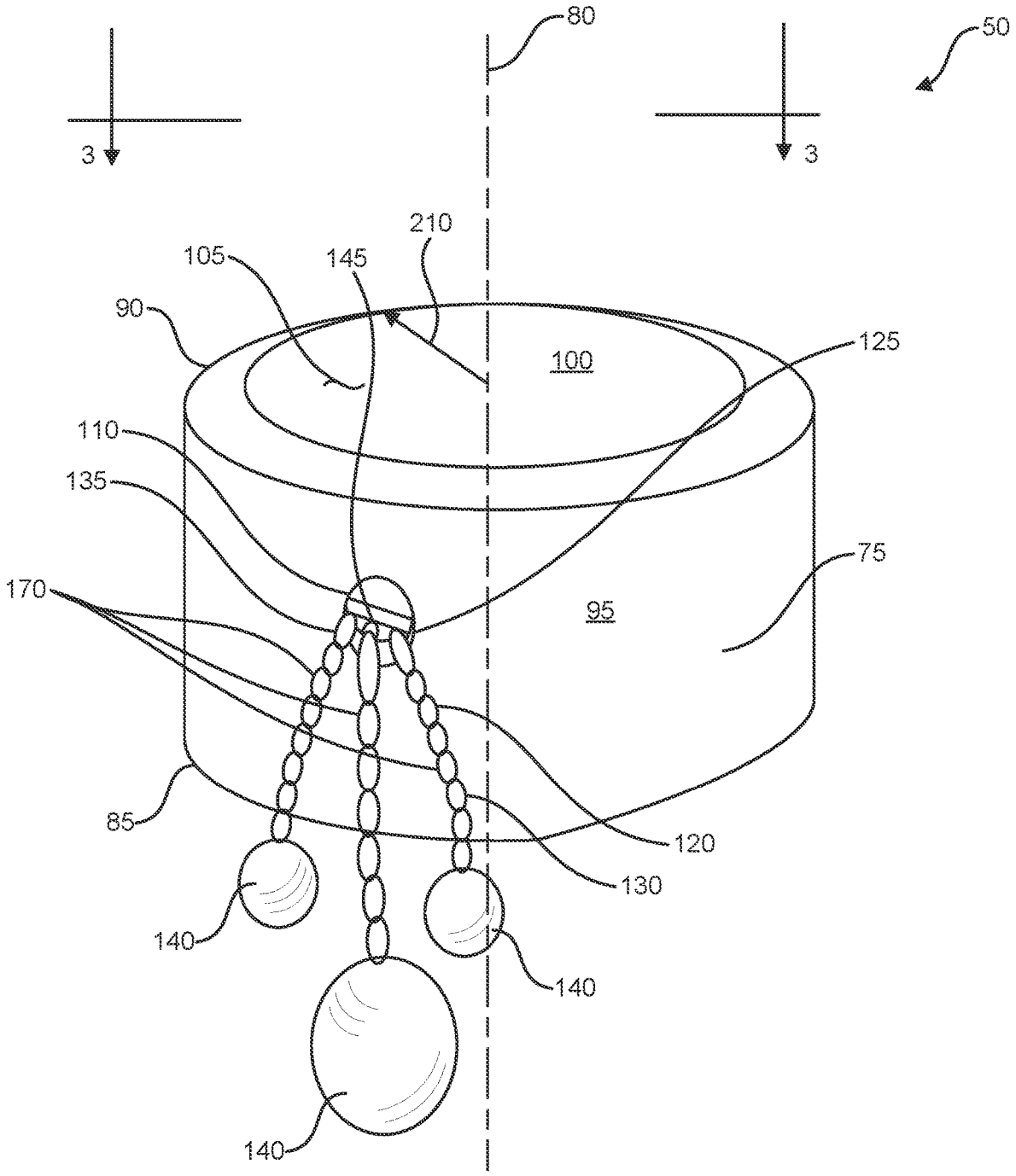
FIG. 2 shows an upper perspective view of the article retention apparatus that includes a surrounding sidewall that is about a longitudinal axis, the inner and outer surfaces of the surrounding sidewall, the surrounding sidewall interior, and the first and second end portions of the surrounding sidewall with the aperture shown, wherein a flexible element is disposed therethrough the aperture with an ornamental element disposed on a distal end portion of the flexible element.

Next, FIG. 2 shown is the upper perspective view of the article retention apparatus 50 that includes a surrounding sidewall 75 that is about a longitudinal axis 80, the inner 100 and outer 95 surfaces of the surrounding sidewall 75, the surrounding sidewall interior 105, and the first 85 and second 90 end portions of the surrounding sidewall 75 with the aperture 110 shown, wherein a flexible element 120 is disposed 135 therethrough the aperture 110 with an ornamental element 140 disposed on a distal end portion 130 of the flexible element 120.

Figure 3:
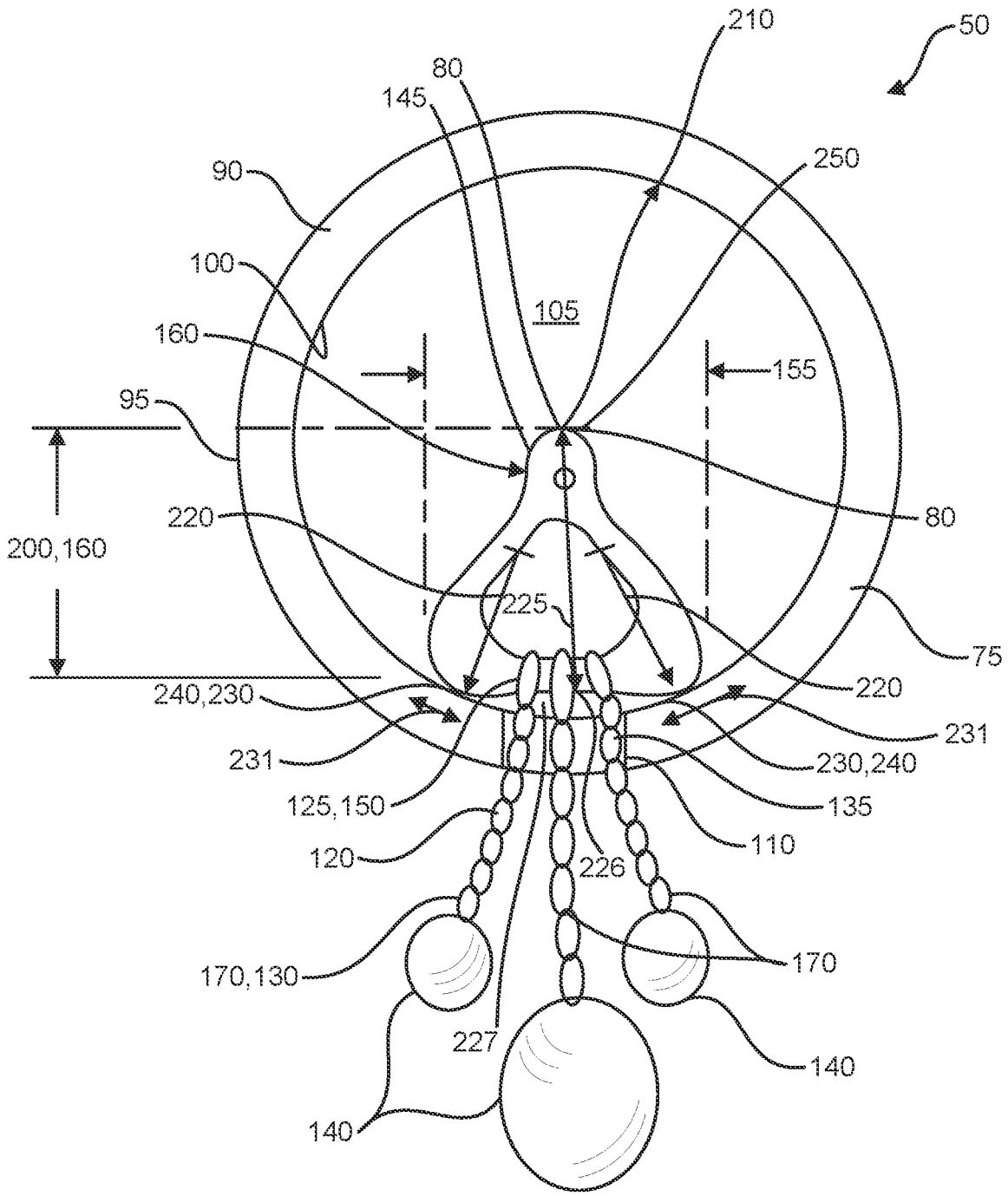

Continuing, FIG. 3 is view 3-3 from FIG. 2, wherein FIG. 3 shows the second end portion 90 view of the surrounding sidewall 75 with the inner 100 and outer 95 surfaces, the surrounding sidewall interior 105, the aperture 110, the flexible element 120 with the proximal 125 and distal 130 end portions of the flexible element 120 with the ornamental element 140 disposed on the distal end portion 130 of the flexible element 120, and the flexible element 120 disposed 135 therethrough the aperture 110 with a friction head 145 attached 150 to the proximal end portion 125 of the flexible element 120, also shown is the friction head 145 projecting 160 into the surrounding sidewall 75 interior 105.

Figure 4:
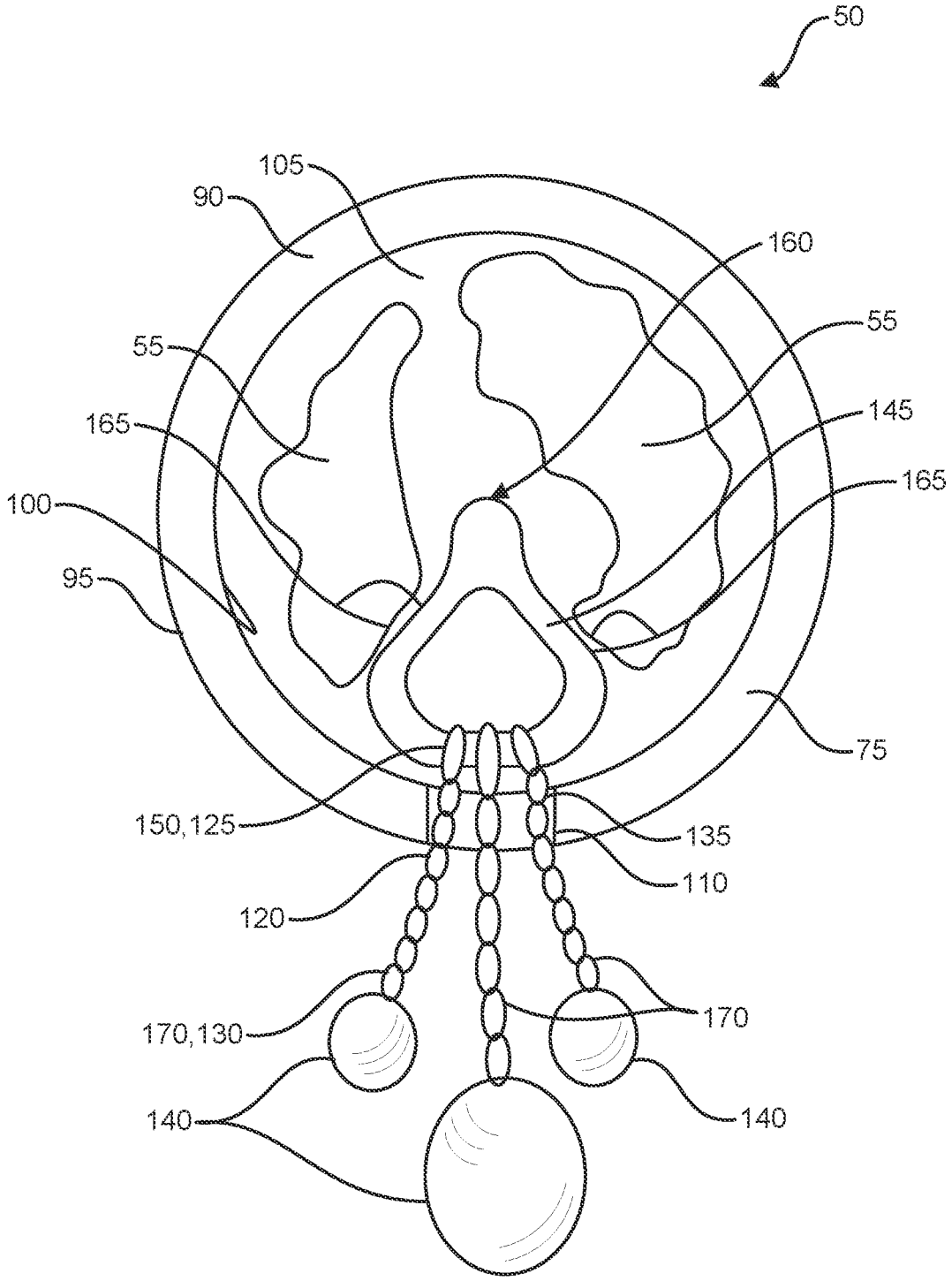
Figure 5:
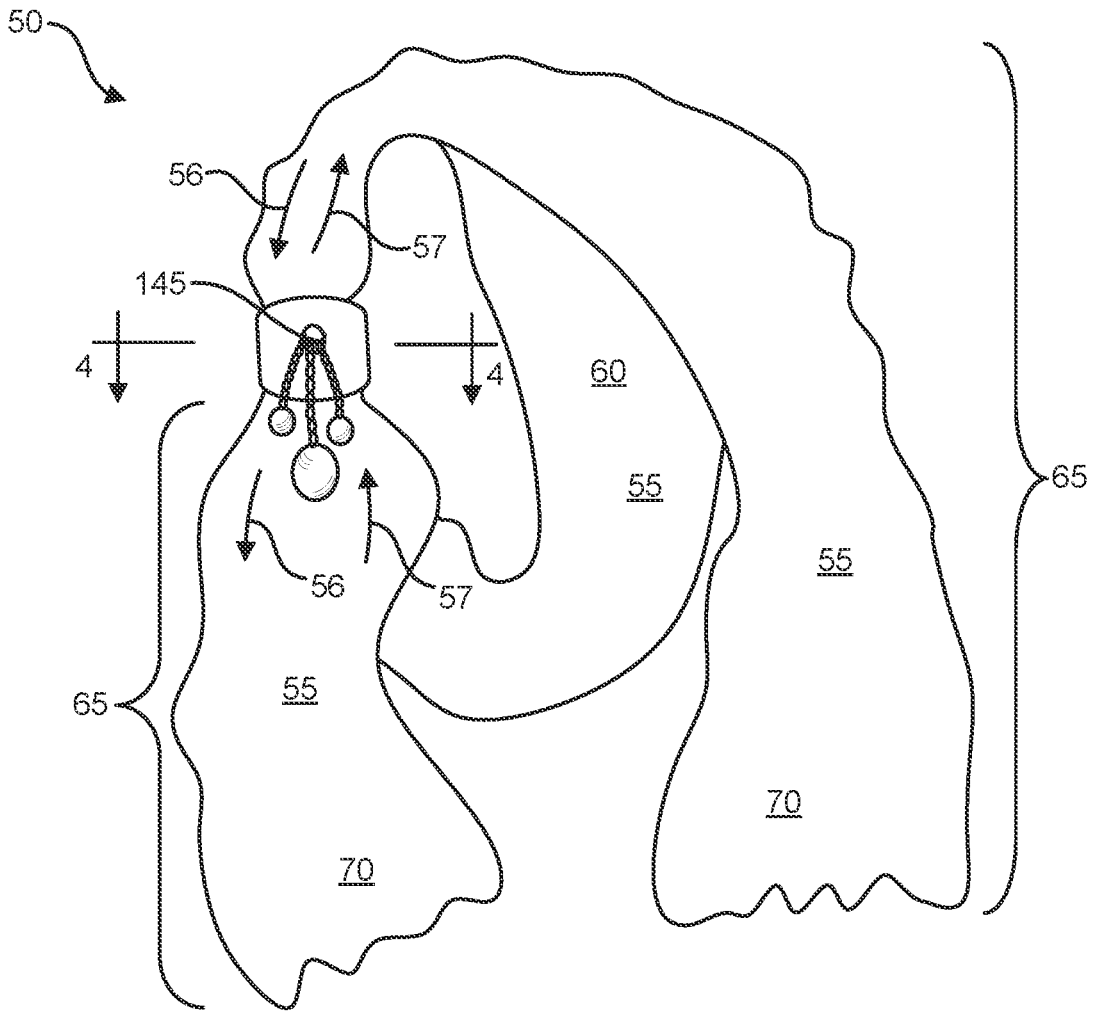
FIG. 5 shows the article retention apparatus with the article, a loop of the article, an elongated shape of the article, and the two free ends of the article, with the article threaded therethrough the surrounding sidewall interior of the article retention apparatus.
Figure 6:
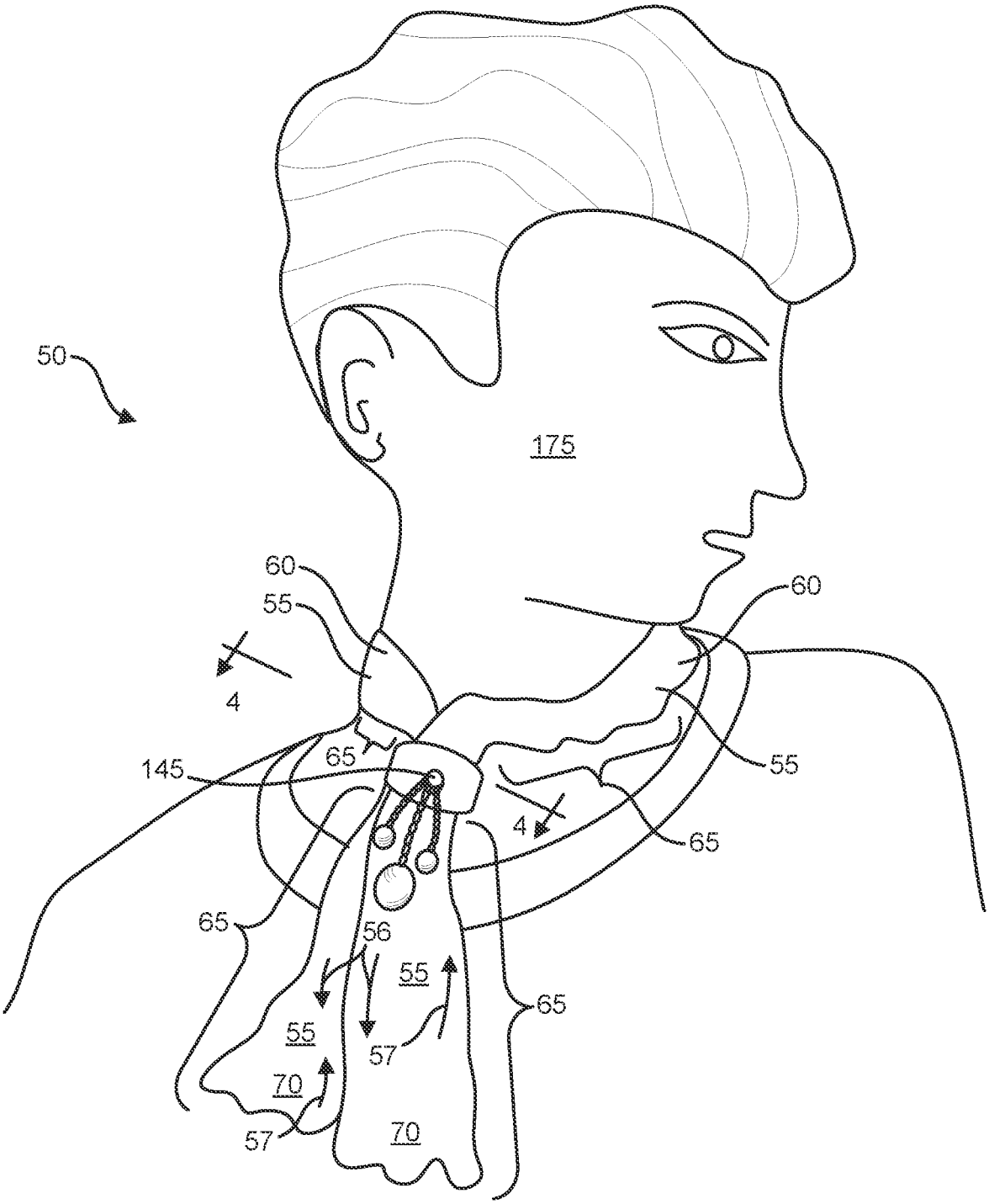
FIG. 6 shows the use view of the article retention apparatus with the user wearing the article, with the loop of the article around the user's neck, the elongated shape of the article, and the two free ends of the article, with the article threaded therethrough the surrounding sidewall interior of the article retention apparatus.

Further, FIG. 4 is view 4-4 in FIGS. 5 and 6, wherein FIG. 4 is the FIG. 3 view with the addition of the article 55 including the two free ends 70 of the article 55 shown, wherein FIG. 4 also shows the second end portion 90 view of the surrounding sidewall 75 with the inner 100 and outer 95 surfaces, the surrounding sidewall interior 105, the aperture 110, the flexible element 120 with the proximal 125 and distal 130 end portions of the flexible element 120 with the ornamental element 140 disposed on the distal end portion 130 of the flexible element 120 and the flexible element 120 disposed 135 therethrough the aperture 110 with a friction head 145 attached 150 to the proximal end portion 125 of the flexible element 120. Also shown is the friction head 145 projecting 160 into the surrounding sidewall 75 interior 105, wherein the friction head 145 compresses 165 the two free ends 70 of the article 55 that are threaded therethrough the interior 105 of the surrounding sidewall 75.

Moving onward, FIG. 5 shows the article retention apparatus 50 with the article 55, a loop 60 of the article 55, an elongated shape 65 of the article 55, and the two free ends 70 of the article 55, with the article 55 threaded therethrough the surrounding sidewall 75 interior 105 of the article retention apparatus 50.

Further, FIG. 6 shows the use view of the article retention apparatus 50 with the user 175 wearing the article 55, with the loop 60 of the article 55 around the user's 175 neck, the elongated shape 65 of the article 55, and the two free ends 70 of the article 55, with the article 55 threaded therethrough the surrounding sidewall 75 interior 105 of the article retention apparatus 50.

Figure 7:
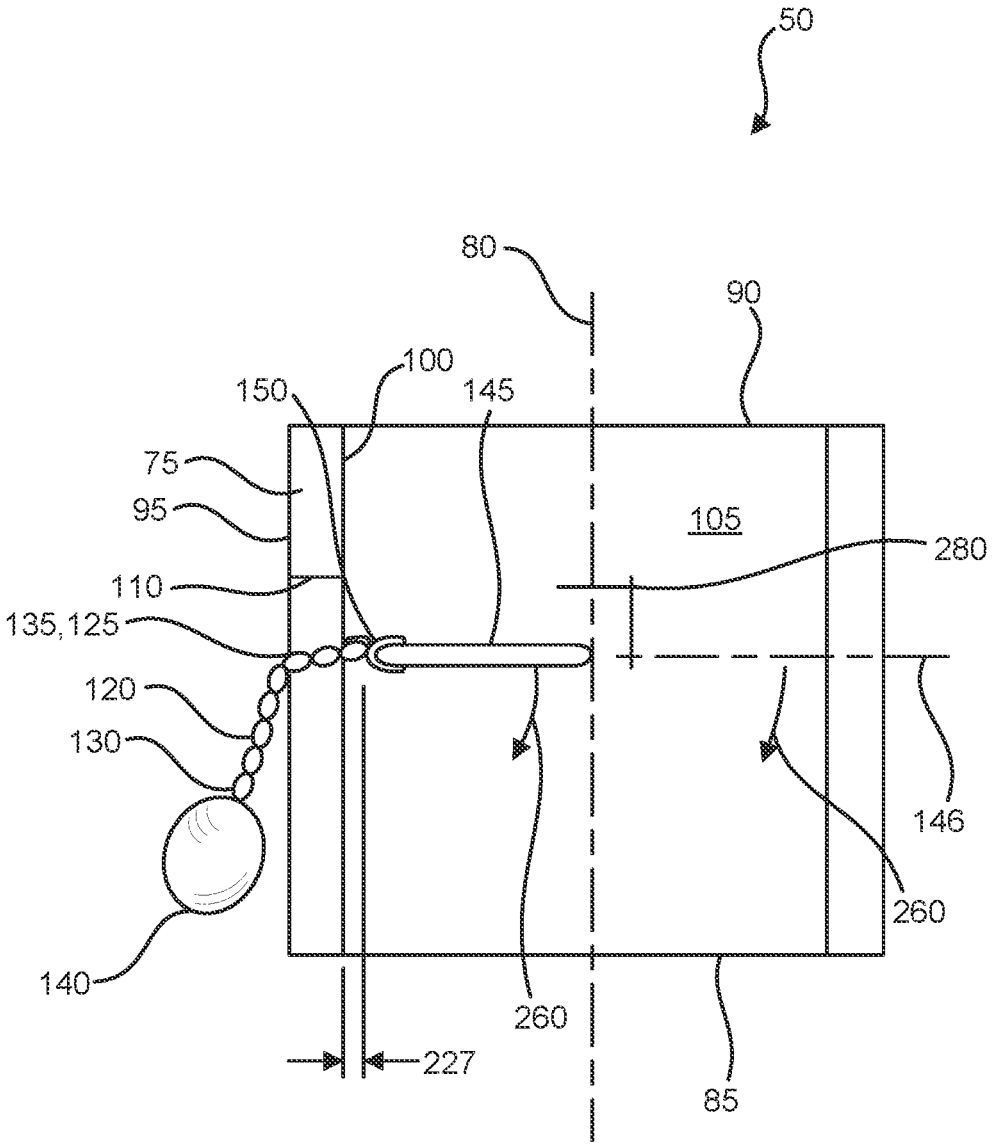
FIG. 7 shows a cross section of the surrounding sidewall with the friction head and the friction head first plane being perpendicular to the longitudinal axis from the weight of the flexible element and ornamental element as being an upward limit on the first free movement of the first plane.

Next, FIG. 7 shows a cross section of the surrounding sidewall 75 with the friction head 145 and the friction head first plane 146 being perpendicular 280 to the longitudinal axis 80 from the weight of the flexible element 120 and ornamental element 140, as being an upward limit on the first free movement 260 of the first plane 146.

Figure 8:
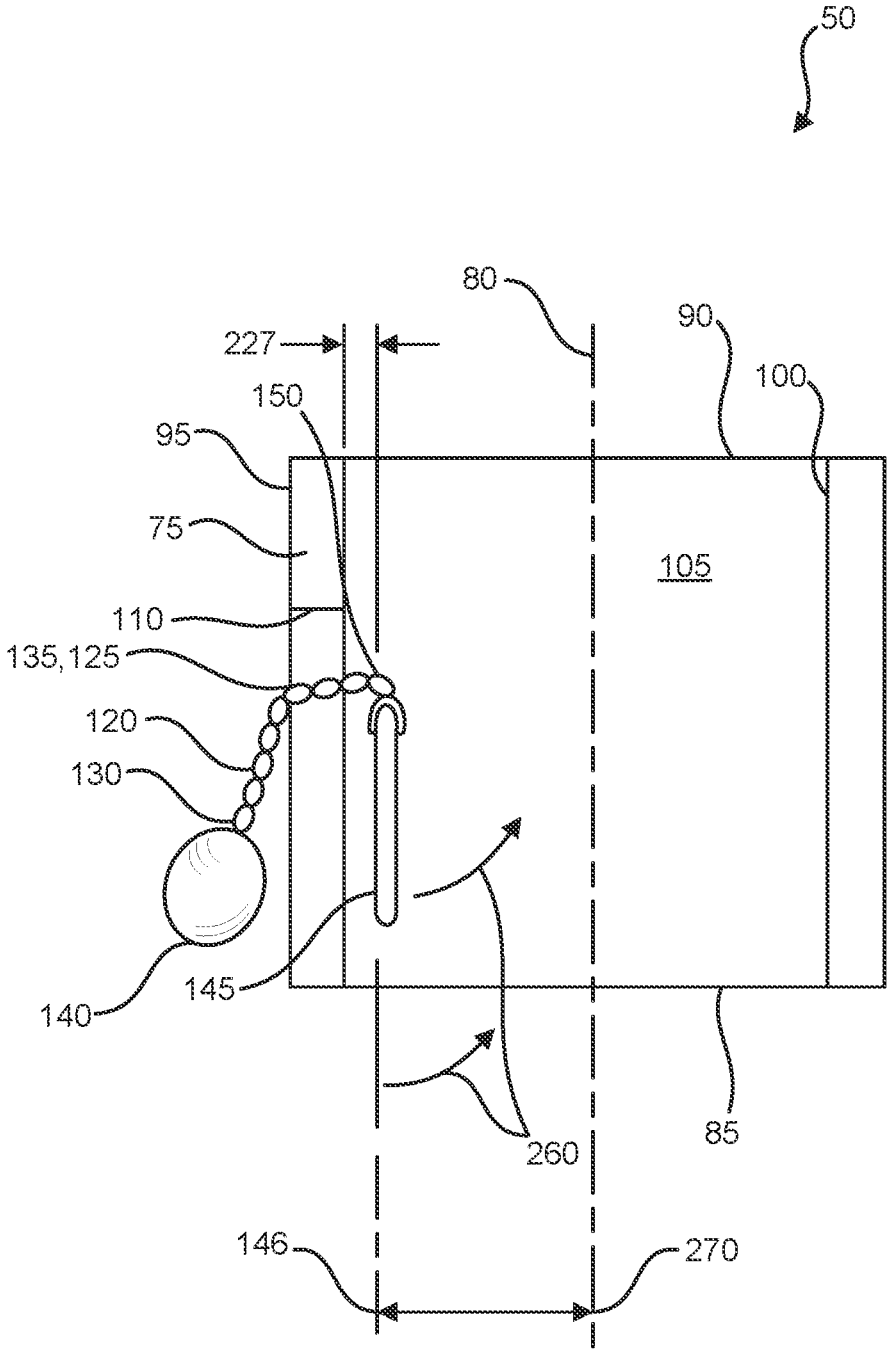
FIG. 8 shows a cross section of the surrounding sidewall with the friction head and the friction head first plane being parallel to the longitudinal axis from the reduction of the weight of the flexible element and ornamental element with the friction head hanging vertically downward in a resting position as being a downward limit on the first free movement of the first plane.

Continuing, FIG. 8 shows a cross section of the surrounding sidewall 75 with the friction head 145 and the friction head first plane 146 being parallel 270 to the longitudinal axis 80 from the reduction of the weight of the flexible element 120 and ornamental element 140 with the friction head 145 hanging vertically downward in a resting position as being a downward limit on the first free movement 260 of the first plane 146.

Figure 9:
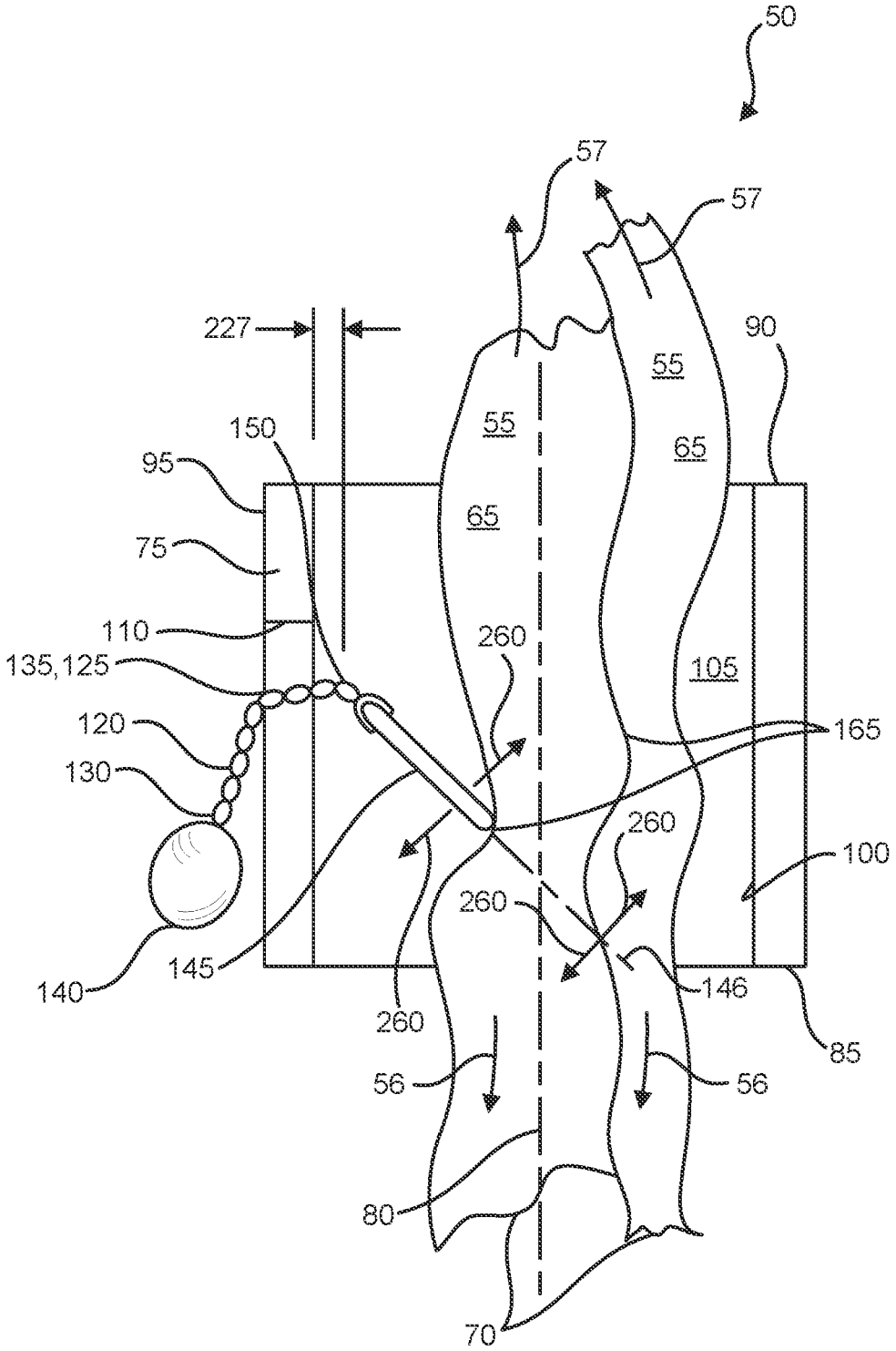
FIG. 9 shows a cross section of the surrounding sidewall with the friction head and the friction head first plane being in the first free movement in moving towards compressing the article from weight of the flexible element and ornamental element as being in transition from in-between what is shown in FIG. 8 to FIG. 7, wherein the friction head has the moving pivotal bearing tangential contact with the surrounding sidewall inner surface to compress the ends of the article as shown to help retain the article within the interior of the surrounding sidewall via compressing the article as against the inner surface of the surrounding sidewall thus adding friction between the article and the inner surface.

Further, FIG. 9 shows a cross section of the surrounding sidewall 75 with the friction head 145 and the friction head first plane 146 being in the first free movement 260 in moving towards compressing the article 55 from weight of the flexible element 120 and ornamental element 140 as being in transition from in-between what is shown in FIG. 8 to FIG. 7, wherein the friction head 145 has the moving pivotal bearing tangential contact 231 with the surrounding sidewall 75 inner surface 100 to compress the ends of the article 55 as shown to help retain the article 55 within the interior 105 of the surrounding sidewall 75 via compressing the article 55 as against the inner surface 100 of the surrounding sidewall 75 thus adding friction between the article 55 and the inner surface 100.

Figure 10:
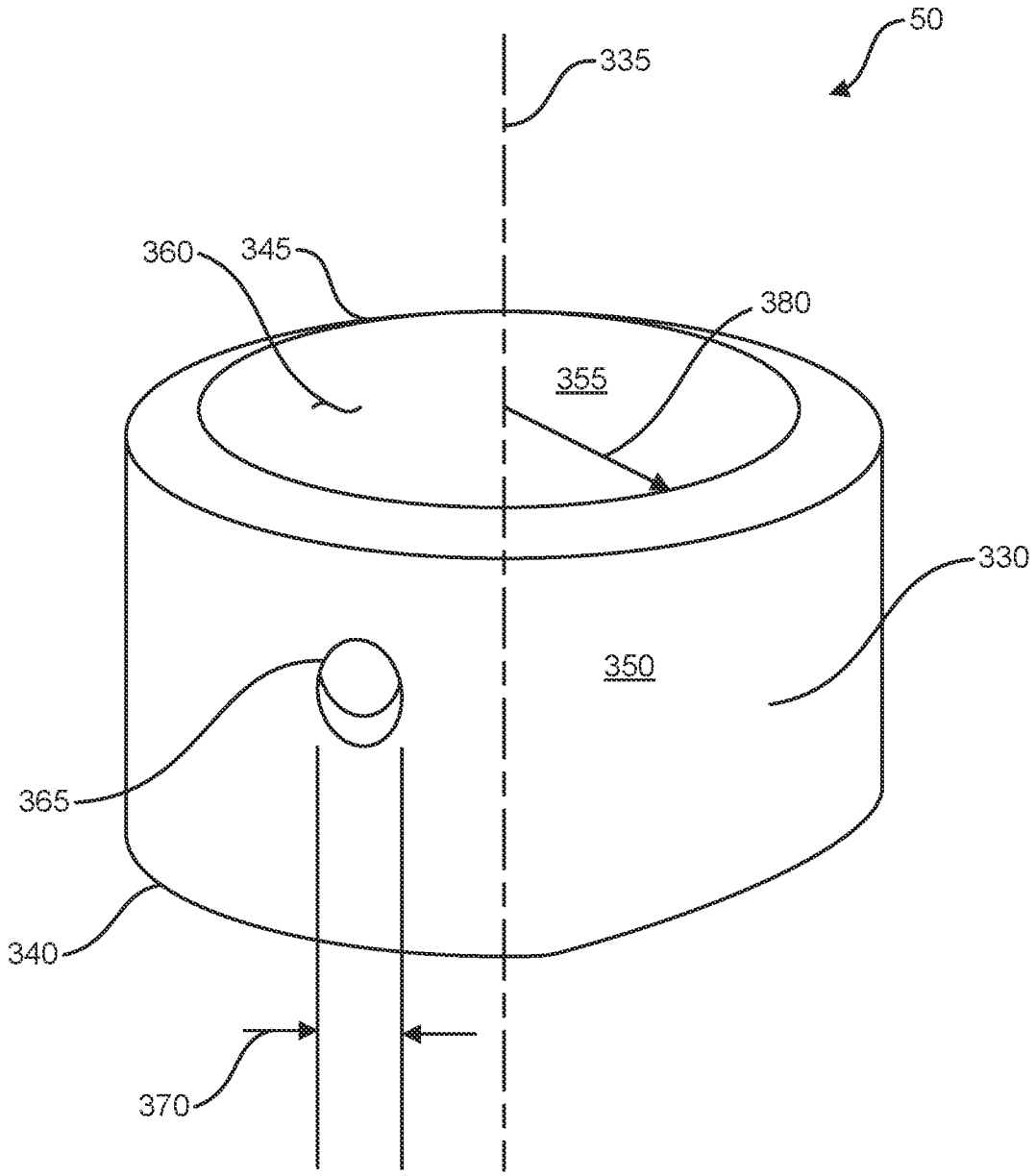
FIG. 10 shows an upper perspective view of the alternative embodiment of the article retention apparatus that includes the surrounding sidewall that is about a longitudinal axis, the inner and outer surfaces of the surrounding sidewall, the surrounding sidewall interior, and the first and second end portions of the surrounding sidewall with the aperture shown.

Moving onward, FIG. 10 shows an upper perspective view of the alternative embodiment of the article retention apparatus 50 that includes the surrounding sidewall 330 that is about a longitudinal axis 335, the inner 355 and outer 350 surfaces of the surrounding sidewall 330, the surrounding sidewall interior 360, and the first 340 and second 345 end portions of the surrounding sidewall 330 with the aperture 365 shown.

Figure 11:
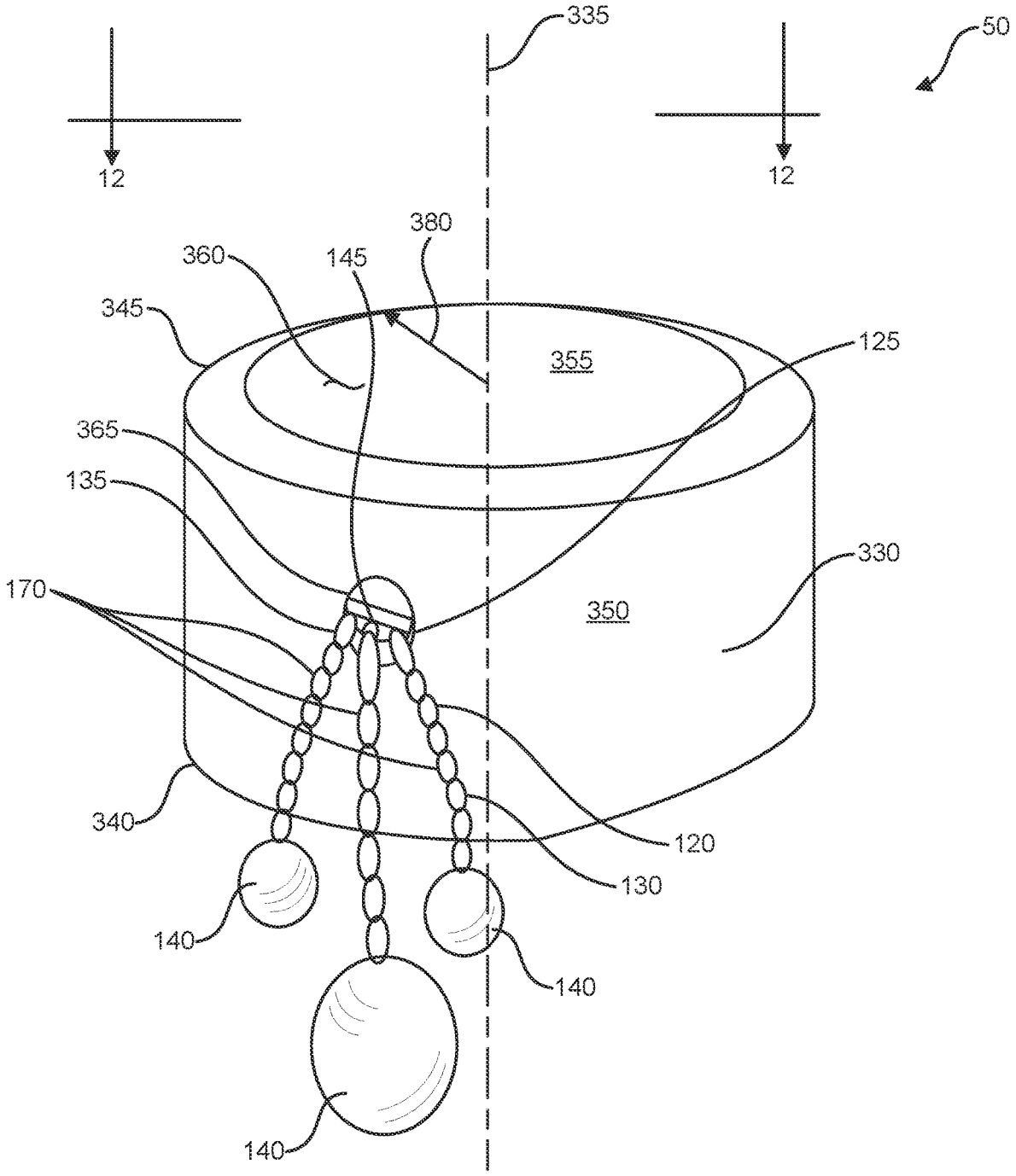
FIG. 11 shows an upper perspective view of the alternative embodiment of the article retention apparatus that includes a surrounding sidewall that is about a longitudinal axis, the inner and outer surfaces of the surrounding sidewall, the surrounding sidewall interior, and the first and second end portions of the surrounding sidewall with the aperture shown, wherein a flexible element is disposed therethrough the aperture with an ornamental element disposed on a distal end portion of the flexible element.

Further, FIG. 11 shows an upper perspective view of the alternative embodiment of the article retention apparatus that includes the surrounding sidewall 330 that is about the longitudinal axis 335, the inner 355 and outer 350 surfaces of the surrounding sidewall 330, the surrounding sidewall interior 360, and the first 340 and second 345 end portions of the surrounding sidewall 330 with the aperture 365 shown, wherein a flexible element 120 is disposed therethrough the aperture 365 with an ornamental element 140 disposed on a distal end portion 130 of the flexible element 120.

Figure 12:
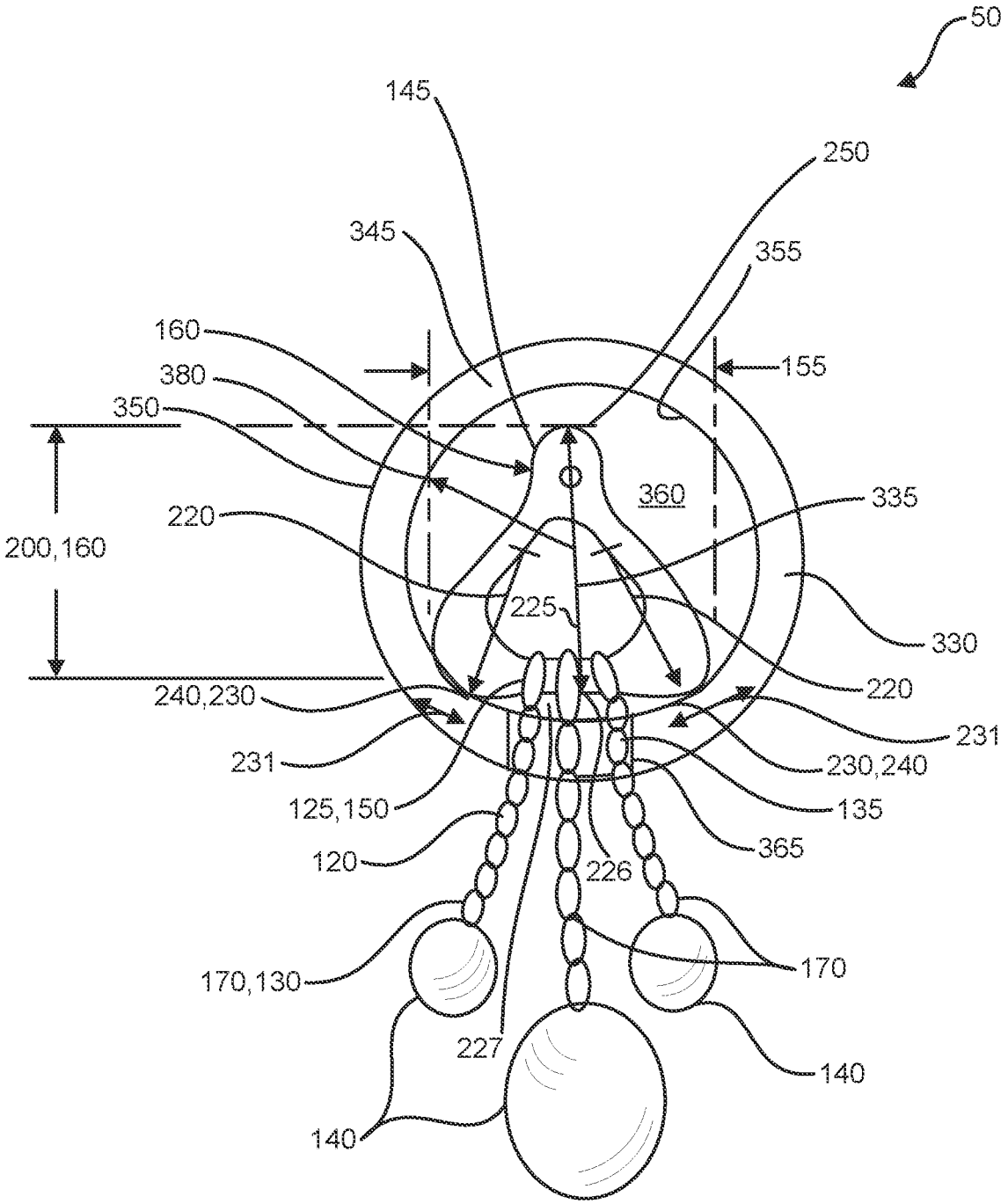

Next, FIG. 12 is view 12-12 from FIG. 11, wherein FIG. 12 shows the second end portion 345 view of the surrounding sidewall 330 with the inner 355 and outer 350 surfaces, the surrounding sidewall interior 360, the aperture 365, the flexible element 120 with the proximal 125 and distal 130 end portions of the flexible element 120 with the ornamental element 140 disposed on the distal end portion 130 of the flexible element 120 and the flexible element 120 disposed therethrough the aperture 365, with a friction head 145 attached to the proximal end portion 125 of the flexible element 120, also shown is the friction head 145 projecting into the surrounding sidewall interior 360.

Figure 13:
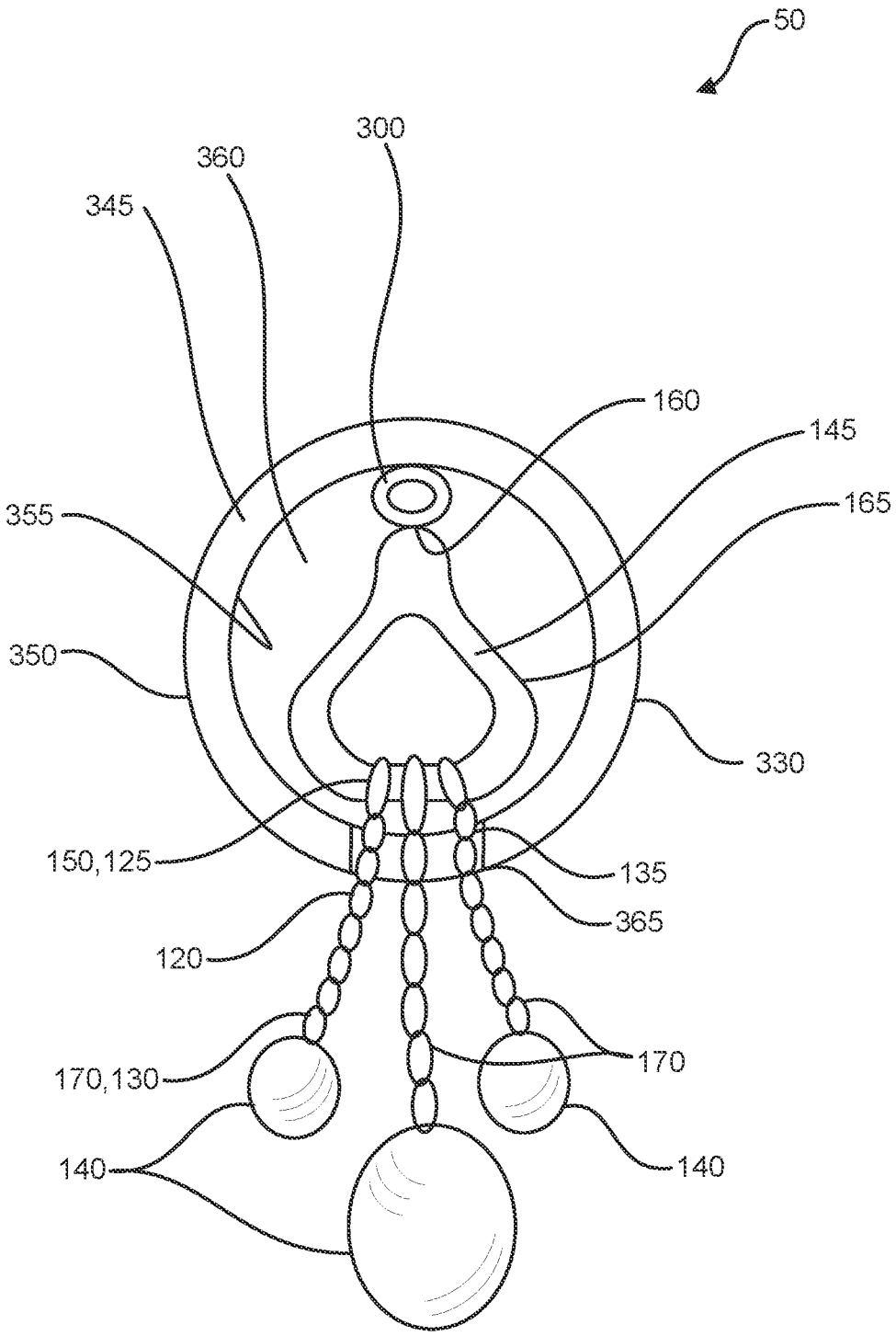
Figure 15:
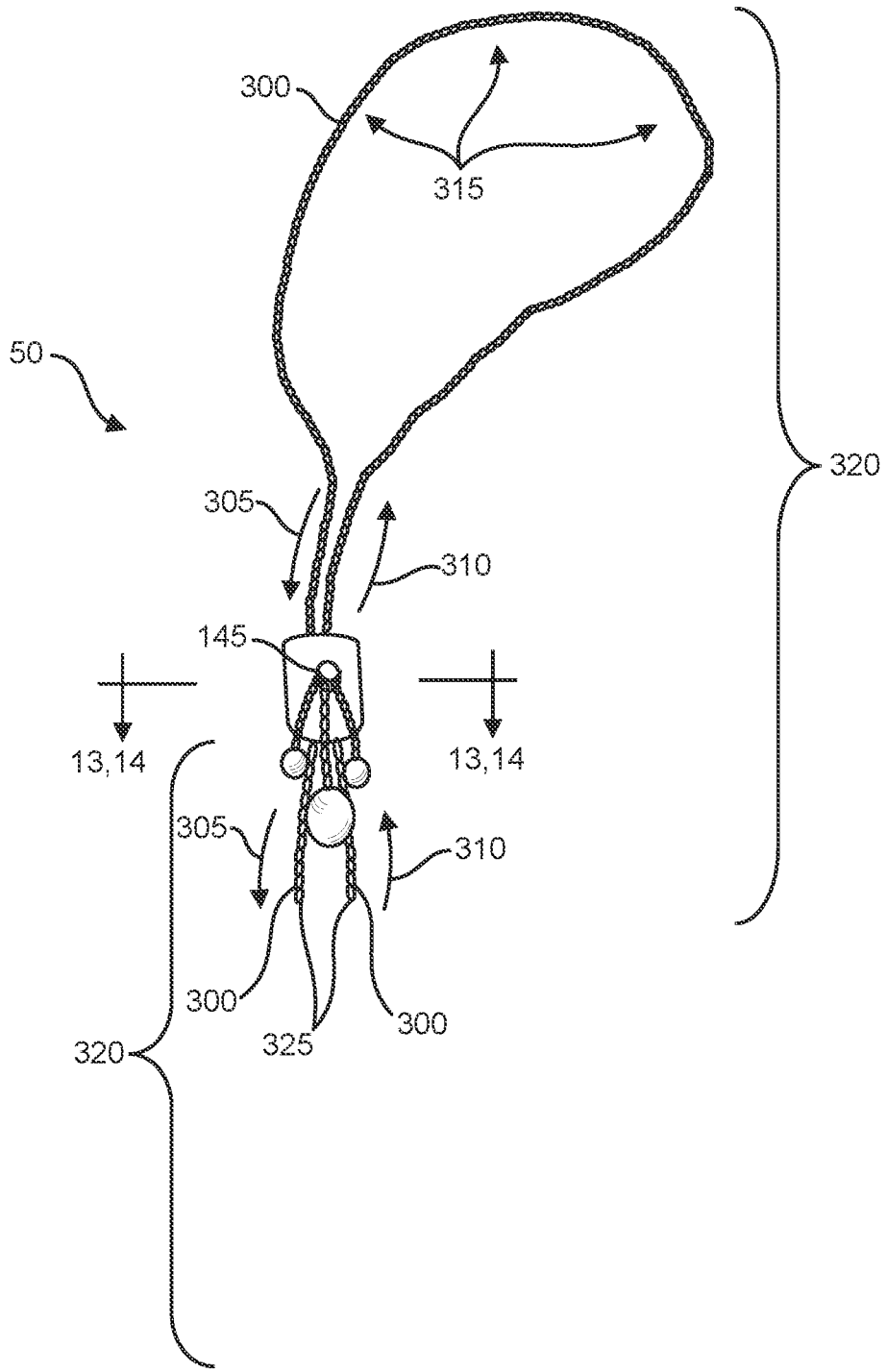
FIG. 15 shows the article retention apparatus with the article, a loop of the article, an elongated shape of the article, and the two free ends of the article, with the article threaded therethrough the surrounding sidewall interior of the article retention apparatus.
Figure 16:
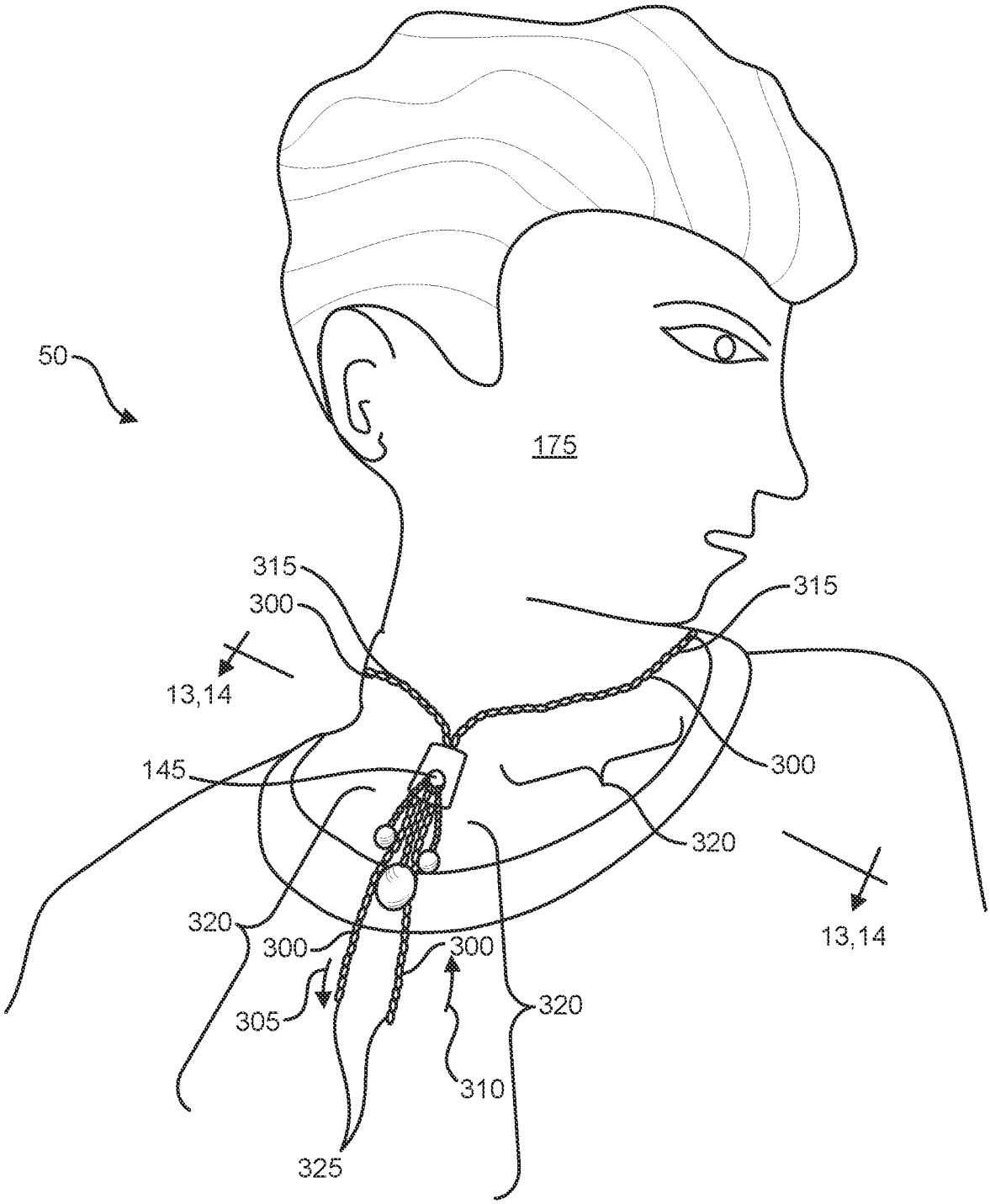
FIG. 16 shows the use view of the article retention apparatus with the user wearing the article, with the loop of the article around the user's neck, the elongated shape of the article, and the two free ends of the article, with the article threaded therethrough the surrounding sidewall interior of the article retention apparatus.
Figure 17:
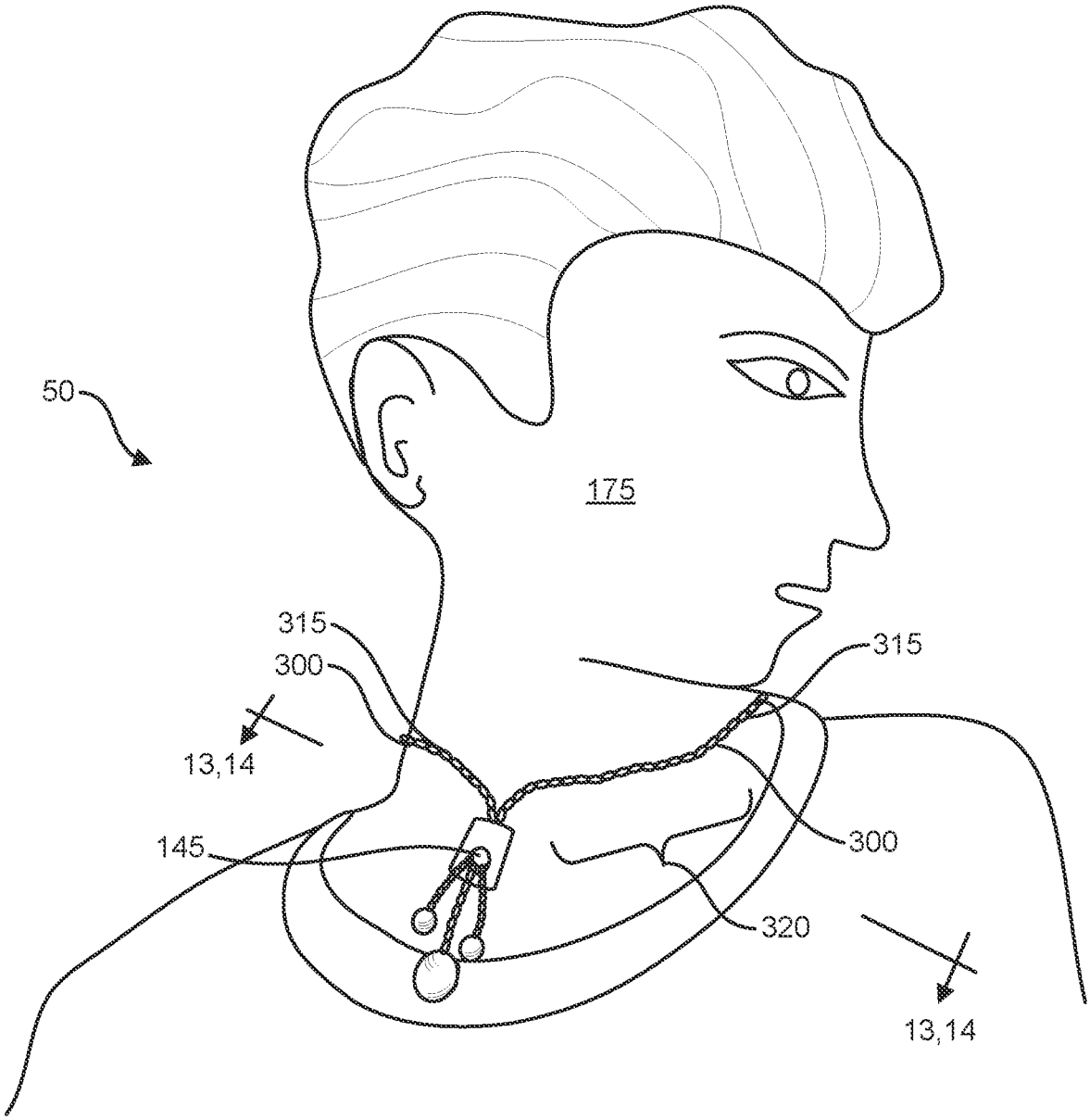
FIG. 17 shows the use view of the article retention apparatus with the user wearing the article, with the loop of the article around the user's neck, the elongated shape of the article, and the two free ends of the article being disposed within the surrounding sidewall (with the two free ends of the article hidden), with the article disposed within the surrounding sidewall interior of the article retention apparatus.

Continuing, FIG. 13 is view 13-13 from FIGS. 15, 16, and 17, wherein FIG. 13 is the FIG. 12 view with the addition of the article 300, FIG. 13 also shows the second end portion 345 view of the surrounding sidewall 330 with the inner 355 and outer 350 surfaces, the surrounding sidewall interior 360, the aperture 365, the flexible element 120 with the proximal 125 and distal 130 end portions of the flexible element 120 with the ornamental element 140 disposed on the distal end portion 130 of the flexible element 120 and the flexible element 120 disposed therethrough the aperture 365 with the friction head 145 attached to the proximal end portion 125 of the flexible element 120, also shown is the friction head 145 projecting into the surrounding sidewall interior 360, wherein the friction head 145 compresses the article 300 that is threaded therethrough the interior 360 of the surrounding sidewall 330.

Figure 14:
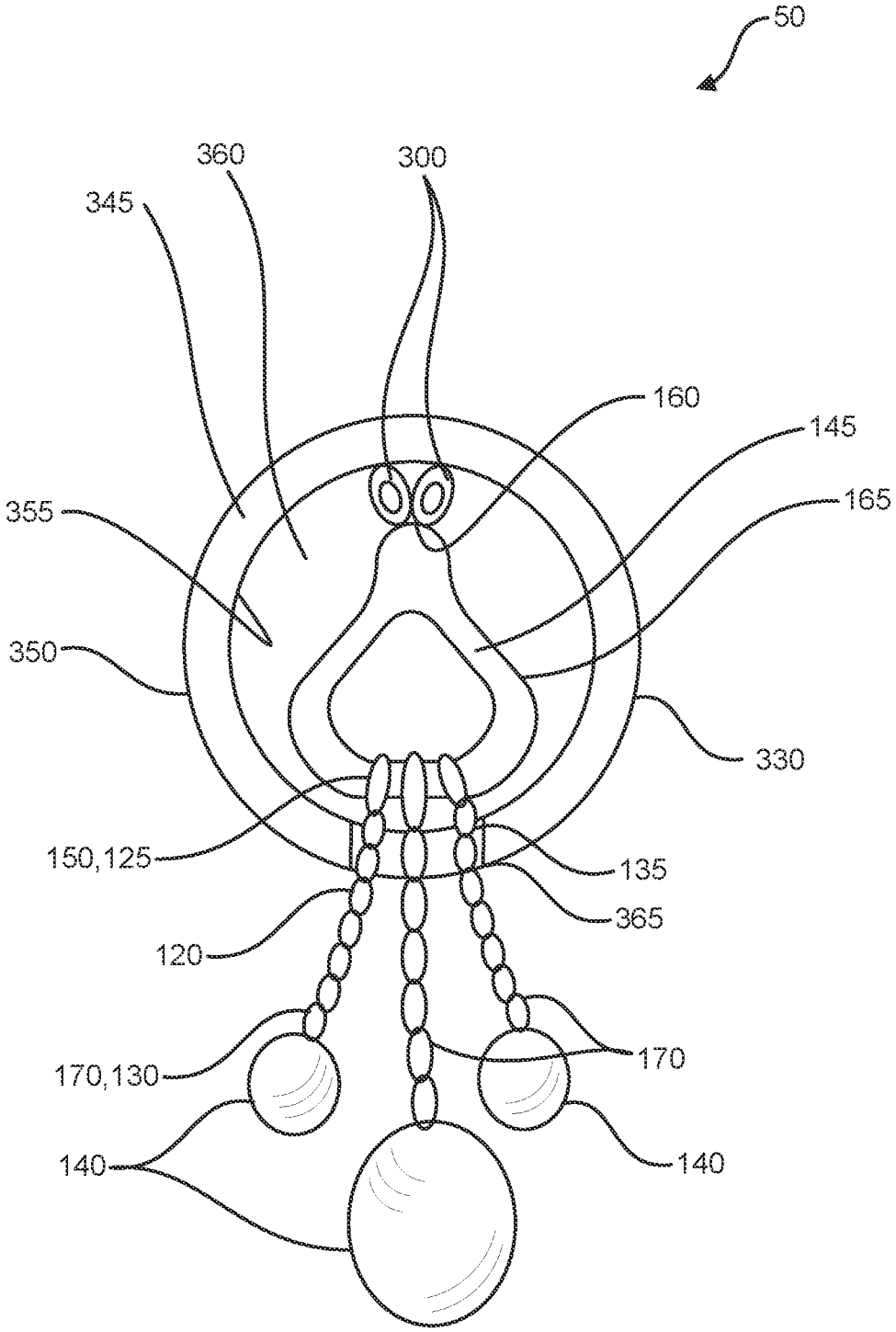

Moving ahead, FIG. 14 is view 14-14 from FIGS. 15, 16, and 17, wherein FIG. 14 is the FIG. 12 view with the addition of the article 300 including two runs of the article 300 shown, wherein FIG. 14 also shows the second end portion 345 view of the surrounding sidewall 330 with the inner 355 and outer 350 surfaces, the surrounding sidewall interior 360, the aperture 365, the flexible element 120 with the proximal 125 and distal 130 end portions of the flexible element 120 with the ornamental element 140 disposed on the distal end portion 130 of the flexible element 120, and the flexible element 120 disposed therethrough the aperture 365 with the friction head 145 attached to the proximal end portion 125 of the flexible element 120. FIG. 14 also shows the friction head 145 projecting into the surrounding sidewall interior 360, wherein the friction head 145 compresses the two free ends 325 of the article 300 that are threaded therethrough the interior 360 of the surrounding sidewall 330.

Further, FIG. 15 shows the article retention apparatus with the article 300, a loop 315 of the article 300, an elongated shape 320 of the article 300, and the two free ends 325 of the article 300, with the article 300 threaded therethrough the surrounding sidewall interior 360 of the article retention apparatus 50.

Next, FIG. 16 shows the use view of the article retention apparatus 50 with the user 175 wearing the article 300, with the loop 315 of the article 300 around the user's 175 neck, the elongated shape 320 of the article 300, and the two free ends 325 of the article 300, with the article 300 threaded therethrough the surrounding sidewall interior 360 of the article retention apparatus 50.

Continuing, FIG. 17 shows the use view of the article retention apparatus 50 with the user 175 wearing the article 300, with the loop 315 of the article 300 around the user's 175 neck, the elongated shape 320 of the article 300, and the two free ends 325 of the article 300 being disposed within the surrounding sidewall 330 (with the two free ends 325 of the article 300 hidden within the surrounding sidewall interior 360), with the article 300 disposed within the surrounding sidewall interior 360 of the article retention apparatus 50.

Figure 18:
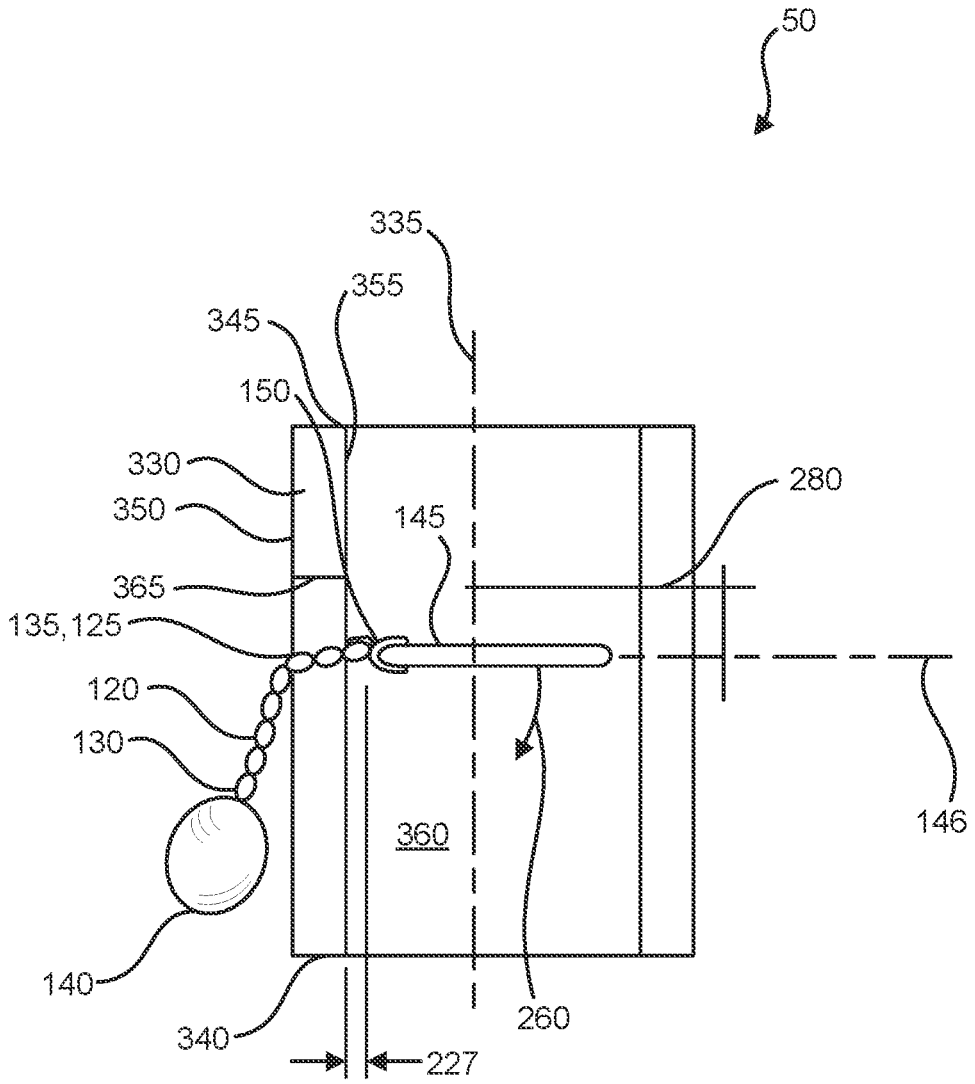
FIG. 18 shows a cross section of the surrounding sidewall with the friction head and the friction head first plane being perpendicular to the longitudinal axis from the weight of the flexible element and ornamental element as being an upward limit on the first free movement of the first plane.

Further, FIG. 18 shows a cross section of the surrounding sidewall 330 with the friction head 145 and the friction head first plane 146 is perpendicular 280 to the longitudinal axis 335 from the weight of the flexible element 120 and ornamental element 140 as being an upward limit on the first free movement 260 of the first plane 146.

Figure 19:
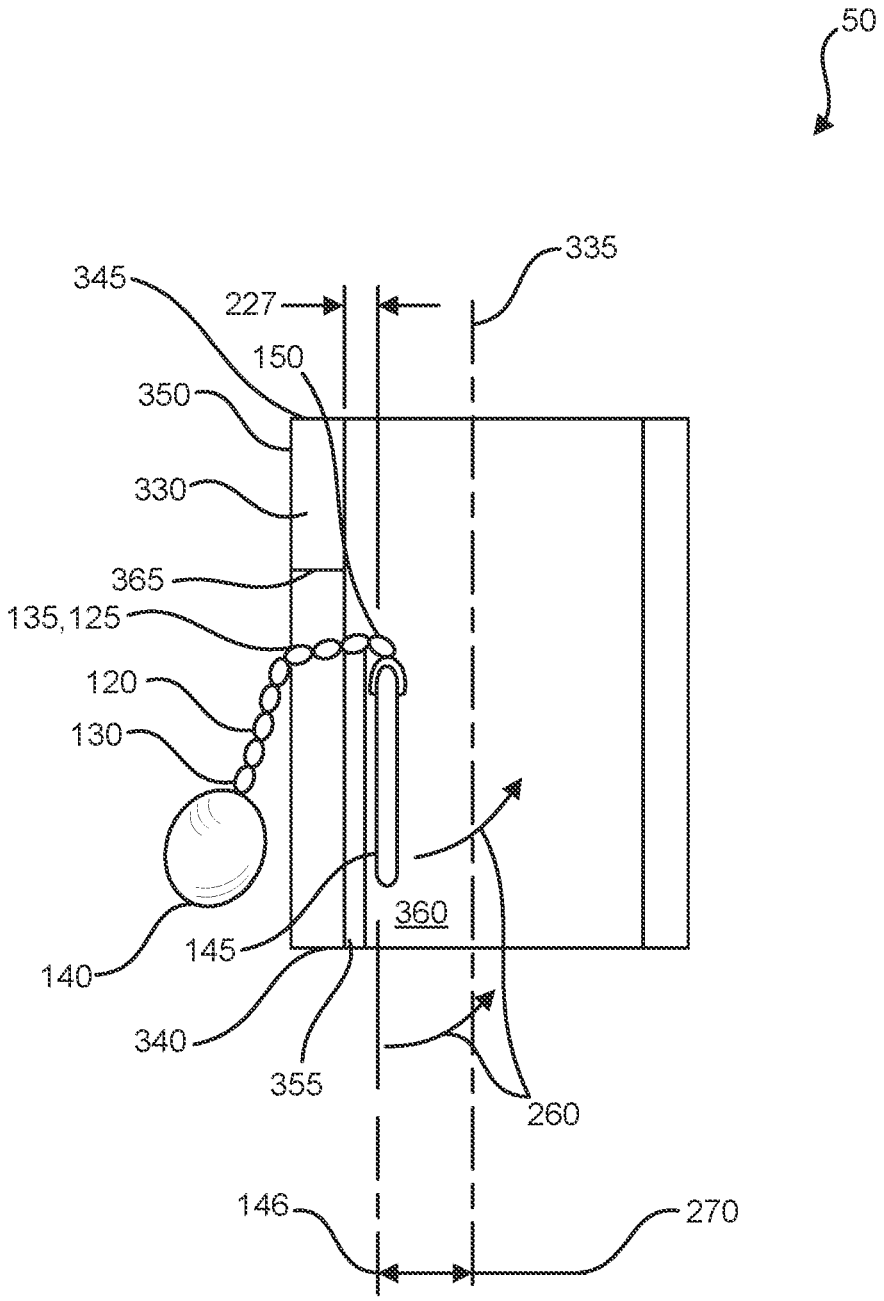
FIG. 19 shows a cross section of the surrounding sidewall with the friction head and the friction head first plane being parallel to the longitudinal axis from the reduction of the weight of the flexible element and ornamental element, with the friction head hanging vertically downward in a resting position as being a downward limit on the first free movement of the first plane.

Next, FIG. 19 shows a cross section of the surrounding sidewall 330 with the friction head 145 and the friction head first plane 146 being parallel 270 to the longitudinal axis 335 from the reduction of the weight of the flexible element 120 and ornamental element 140 with the friction head 145 hanging vertically downward in a resting position as being a downward limit on the first free movement 260 of the first plane 146.

Figure 20:
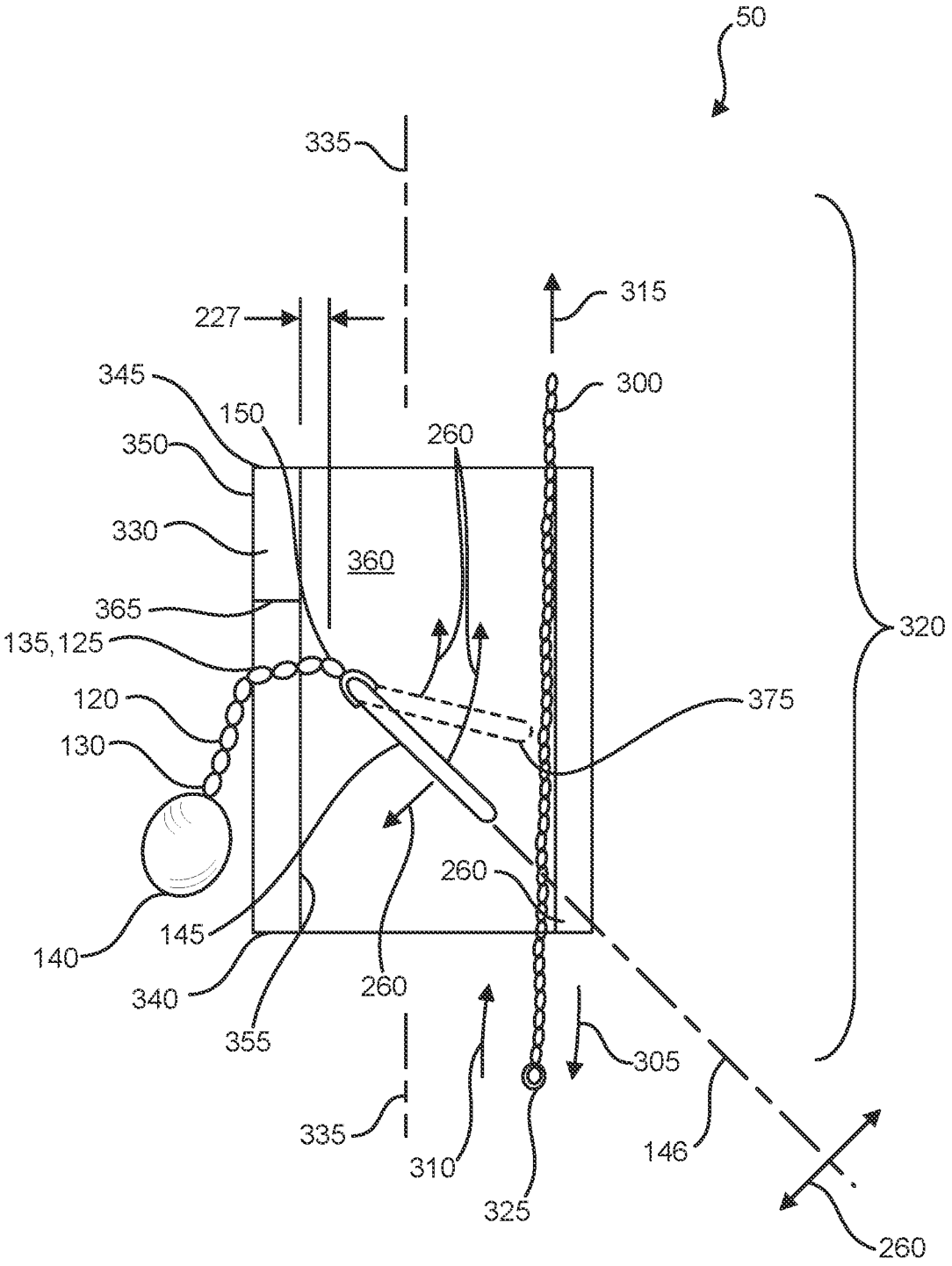
FIG. 20 shows a cross section of the surrounding sidewall with the friction head and the friction head first plane being in the first free movement in moving towards compressing the article from weight of the flexible element and ornamental element as being in transition from in-between what is shown in FIG. 19 to FIG. 18, wherein the friction head has the moving pivotal bearing tangential contact with the surrounding sidewall inner surface to compress the ends of the article as shown to help retain the article within the interior of the surrounding sidewall via compressing the article as against the inner surface of the surrounding sidewall thus adding friction between the article and the inner surface.

Continuing, FIG. 20 shows a cross section of the surrounding sidewall 330 with the friction head 145 and the friction head first plane 146 being in the first free movement 260 in moving towards compressing the article 300 from weight of the flexible element 120 and ornamental element 140 as being in transition from in-between what is shown in FIG. 19 to FIG. 18, wherein the friction head 145 has the moving pivotal bearing tangential contact 231 with the surrounding sidewall inner surface 355 to compress the ends 325 of the article 300 as shown to help retain the article 300 within the interior 360 of the surrounding sidewall 330 via compressing the article 300 as against the inner surface 355 of the surrounding sidewall 330 thus adding friction between the article 300 and the inner surface 355.

Figure 21:
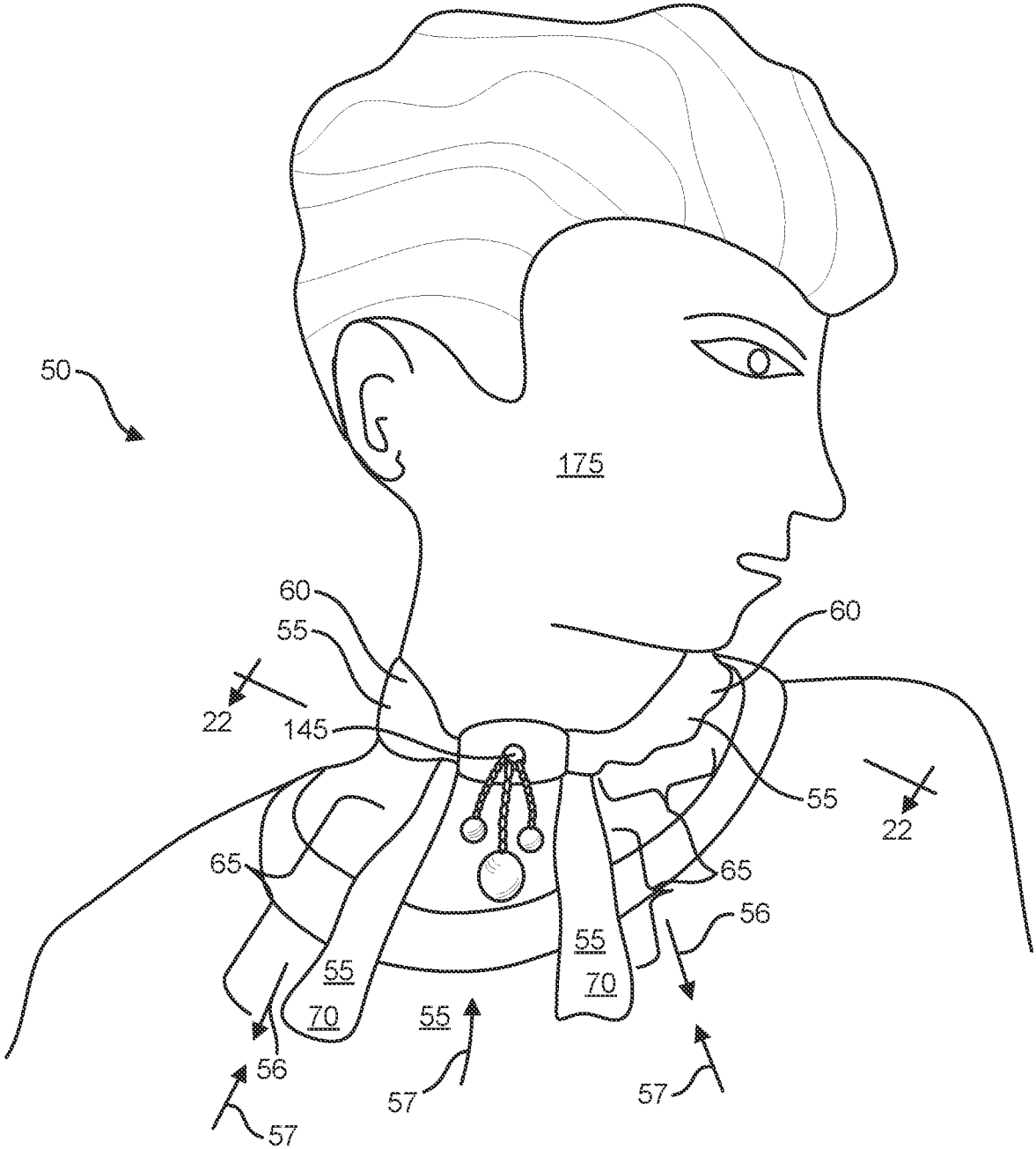
FIG. 21 shows the use view of the article retention apparatus with the user wearing the article, with the loop of the article around the user's neck, the elongated shape of the article, and the two free ends of the article, with the article cross threaded therethrough the surrounding sidewall interior in a lateral manner of the article retention apparatus.

Next, FIG. 21 shows the use view of the article retention apparatus 50 with the user 175 wearing the article 55, with the loop 60 of the article 55 around the user's 175 neck, the elongated shape 65 of the article 55, and the two free ends 70 of the article 55, with the article 55 cross threaded therethrough the surrounding sidewall 75 interior 105 in a lateral manner of the article retention apparatus 50.

Figure 22:
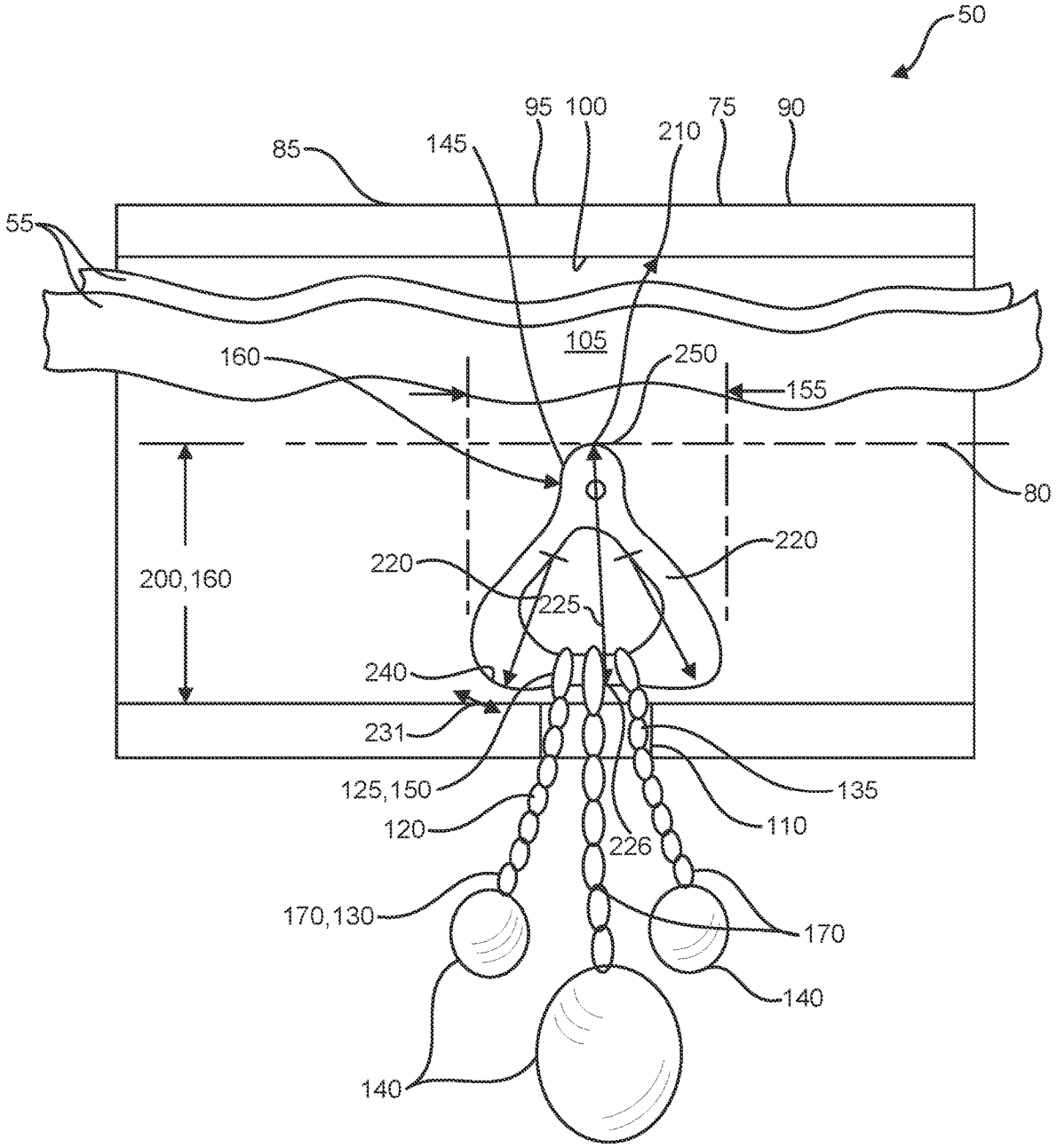

Further, FIG. 22 is view 22-22 from FIG. 21, wherein FIG. 22 shows the surrounding sidewall 75 worn by the user 175 in a lateral positional orientation with the inner 100 and outer 95 surfaces, the surrounding sidewall interior 105, the aperture 110, the flexible element 120 with the proximal 125 and distal 130 end portions of the flexible element 120 with the ornamental element 140 disposed on the distal end portion 130 of the flexible element 120 and the flexible element 120 disposed therethrough 135 the aperture 110 with the friction head 145 attached to the proximal end portion 125 of the flexible element 120, also shown in the friction head 145 projecting into the surrounding sidewall interior 105, wherein the article 55 free ends 70 are threaded therethrough the interior 105 of the surrounding sidewall 75.

Figure 23:
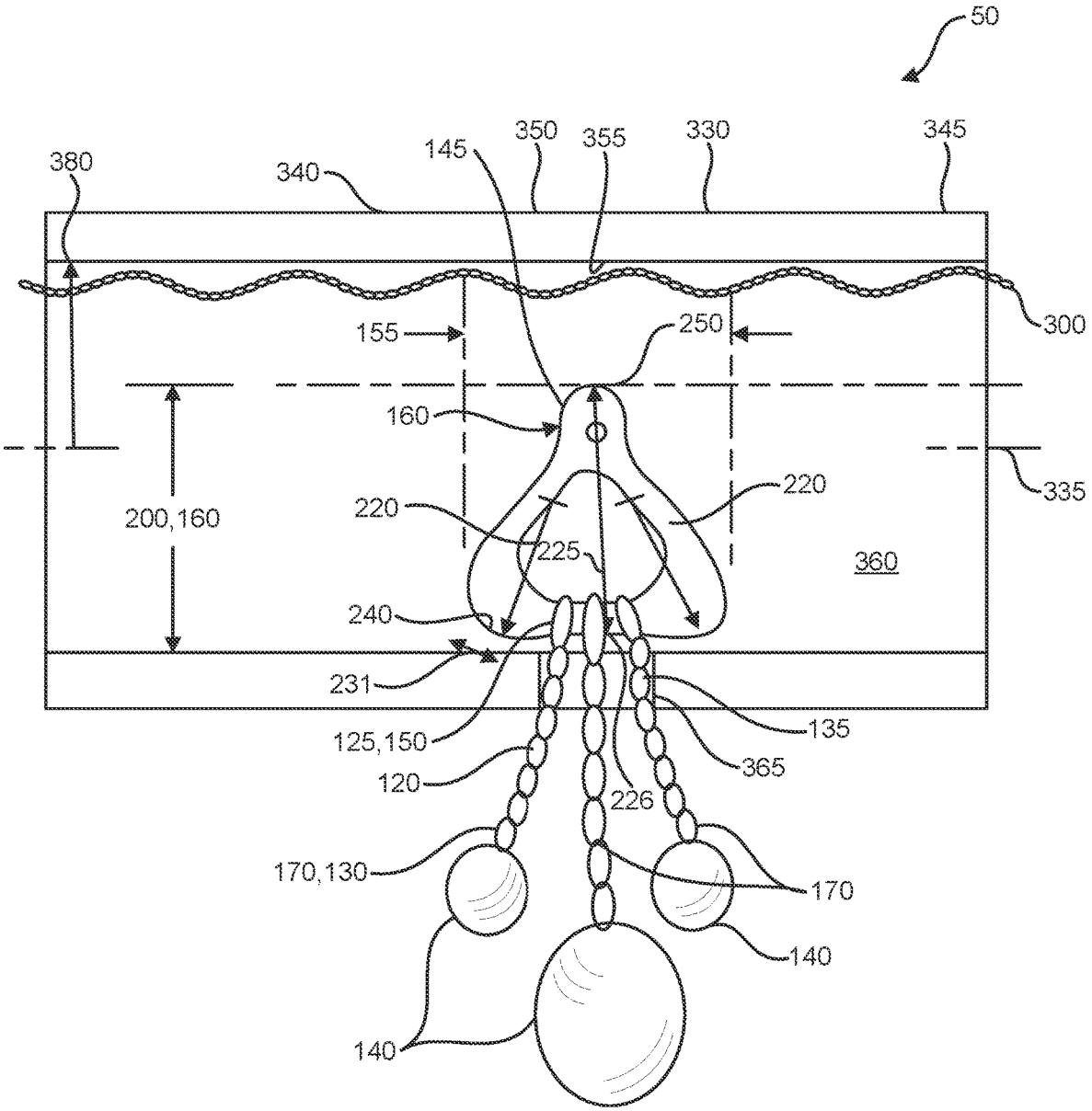
Figure 24:
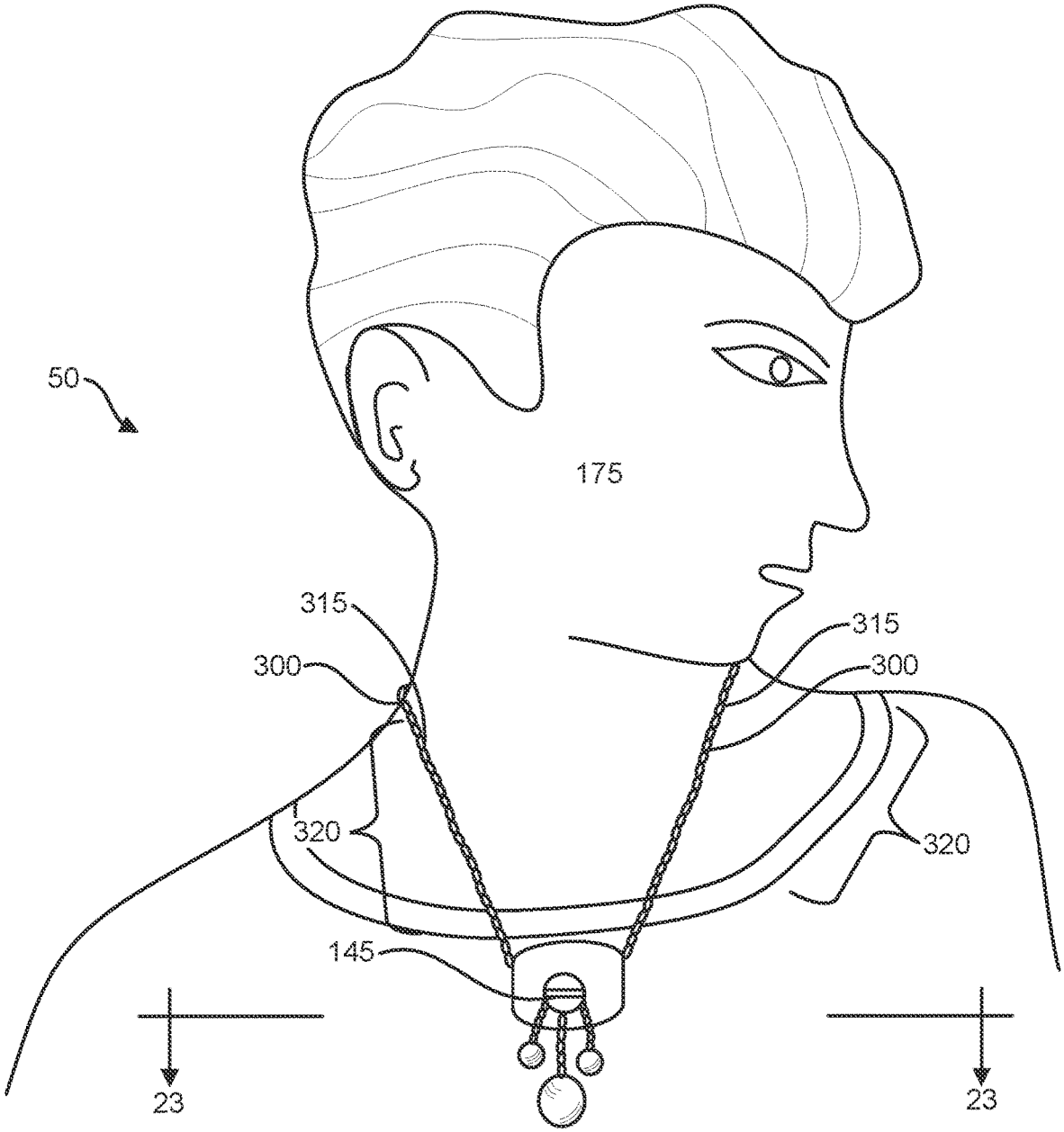
FIG. 24 shows the use view of the article retention apparatus with the user wearing the article, with the loop of the article around the user's neck, the elongated shape of the article, with the article threaded therethrough the surrounding sidewall interior in a lateral manner of the article retention apparatus.

Moving onward, FIG. 23 is view 23-23 from FIG. 24, wherein FIG. 23 shows the surrounding sidewall 330 worn by the user 175 in a lateral positional orientation with the inner 355 and outer 350 surfaces, the surrounding sidewall interior 360, the aperture 365, the flexible element 120 with the proximal 125 and distal 130 end portions of the flexible element 120 with the ornamental element 140 disposed on the distal end portion 130 of the flexible element 120 and the flexible element 120 disposed therethrough 135 the aperture 365 with the friction head 145 attached to the proximal end portion 125 of the flexible element 120, also shown in the friction head 145 projecting into the surrounding sidewall interior 360, wherein the article 300 is threaded therethrough the interior 360 of the surrounding sidewall 330.

Next, FIG. 24 shows the use view of the article retention apparatus 50 with the user 175 wearing the article 300, with the loop 315 of the article 300 around the user's 175 neck, the elongated shape 320 of the article 300, with the article 300 threaded therethrough the surrounding sidewall interior 360 in a lateral manner of the article retention apparatus 50.

Figure 25:
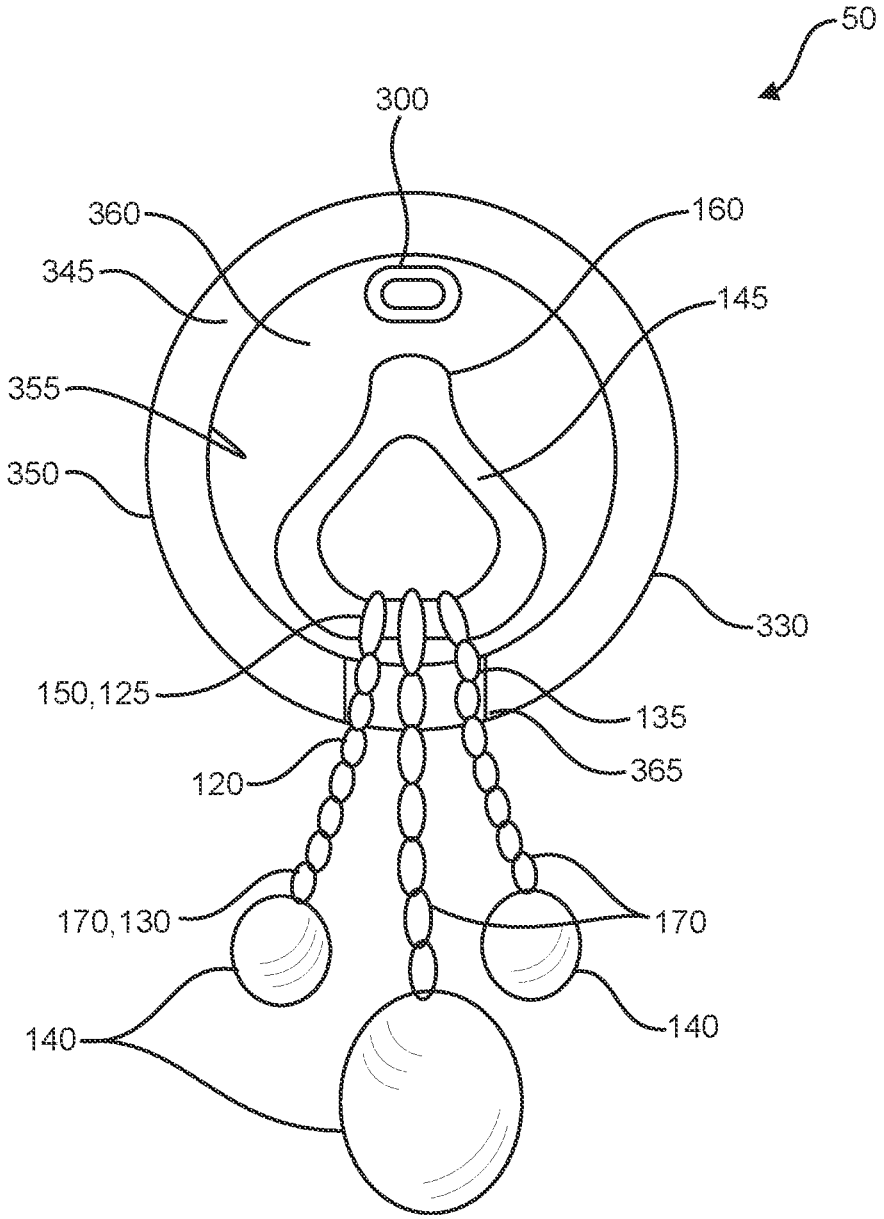

Continuing, FIG. 25 shows a vertical cross section view of FIG. 23 with the friction head 145 rotated into view for clarity, wherein FIG. 25 shows the surrounding sidewall 330 with the inner 355 and outer 350 surfaces, the surrounding sidewall interior 360, the aperture 365, the flexible element 120 with the proximal 125 and distal 130 end portions of the flexible element 120 with the ornamental element 140 disposed on the distal end portion 130 of the flexible element 120 and the flexible element 120 disposed therethrough 135 the aperture 365 with the friction head 145 attached to the proximal end portion 125 of the flexible element 120, also shown is the friction head 145 projecting into the surrounding sidewall interior 360.

Broadly, in referring to structural FIGS. 1 to 4, 7 to 14, 18 to 20, 22, 23, and 25, the article retention apparatus 50 is adapted to retain the article 55, 300 in a loop 60, 315, wherein the article 55, 300 is in an elongated shape 65, 320 having two free ends 70, 325, the article retention apparatus 50 includes the surrounding sidewall 75, 330 about the longitudinal axis 80, 335, the surrounding sidewall 75, 330 having the first end portion 85, 340 and the opposing second end portion 90, 345 with the longitudinal axis 80, 335 spanning therebetween, the surrounding sidewall 75, 330 having the outer surface 95, 350 and the opposing inner surface 100, 355 that defines the surrounding sidewall interior 105, 360.

Further the article retention apparatus 50 includes the aperture 110, 365 disposed therethrough the surrounding sidewall 75, 330 from the outer surface 95, 350 to the inner surface 100, 355, the aperture 110, 365 having the aperture largest dimension 115, 370. Also, the flexible element 120 having the proximal end portion 125 and the opposing distal end portion 130, wherein the flexible element 120 is partially disposed 135 therethrough the aperture 110, 365, the flexible element 120 is positioned such that the flexible element 120 proximal end portion 125 is disposed within the surrounding sidewall 75, 330 interior 105, 360 and the flexible element 120 distal end portion 130 is adjacent to the surrounding sidewall 75, 330 outer surface 95, 360, with the ornamental element 140 affixed to the flexible element 120 distal end portion 130.

Further the article retention apparatus 50 includes the friction head 145 affixed to the flexible element 120 proximal end portion 125, the friction head 145 having a maximum dimension 155 that is greater than the aperture 110, 365 largest dimension 115, 370, the friction head 145 projects 160 into the surrounding sidewall 75, 330 interior 105, 360, further the friction head 145 is substantially planar forming a first plane 146, and operationally accomplishes two functions, a first function is to retain the flexible element 120 within the aperture 110, 365 and a second function is to compress 165, 375 the two free ends of the article 55, 300 that are threaded therethrough the interior 105, 360 of the surrounding sidewall 75, 330 to add friction to the free ends 70, 325 of the article 55, 300 to further help retain the article two free ends 70, 325 to be adjacent to one another via the article retention apparatus 50, see in particular FIGS. 5, 6, 15, 16, and 17.

Alternatively for the article retention apparatus 50 can further comprise a plurality of flexible elements 120 that each have a proximal end portion 125 that are each affixed 150 to the friction head 145, wherein each flexible element 120 distal end portion 130 has a separate ornamental element 140 affixed thereto, see FIGS. 2 to 6, and FIGS. 11 to 17.

A further alternative for the article retention apparatus 50 is wherein where the friction head projects 145 into the surrounding sidewall interior 105, 360 a projection distance 200 that is equal to or greater than a first radius 210 going from the longitudinal axis 80, 335 to the surrounding sidewall 75, 330 inner surface 100, 355, wherein the projection distance 200 terminates in a projection surface to operationally further compress 165, 375 the two free ends 70, 325 of the article 55, 300 that are threaded therethrough the interior 105, 360 of the surrounding sidewall 75, 330 to add friction to the free ends 70, 325 of the article 55, 300 to further help retain the article two free ends 70, 325 to be adjacent to one another via the article retention apparatus 50, see FIGS. 3, 4, 7, 8, 9, 12, 13, 14, and 18 to 20.

An option for the article retention apparatus 50 is wherein the friction head 145 can further comprise a second radius 220 terminating in a second surface, wherein the second radius 220 is less than the first radius 210, wherein the second surface has a bearing pivotal tangential contact 230 to a portion of the surrounding sidewall inner surface 100, 355, to operationally give the friction head 145 a definite contact to the surrounding sidewall inner surface 100, 355 adjacent to the aperture 110, 365, see in particular FIGS. 3, 4, 12, 13, and 14.

Another option for the article retention apparatus 50 is wherein the ornamental element 140 has a first weight that is greater than a second weight of the friction head 145 to operationally bias the friction head 145 to create a first free movement 260, such that the friction head 145 is moving the first plane 146 from being substantially parallel 270 to the longitudinal axis 80, 335 to being substantially perpendicular 280 to the longitudinal axis 80, 335 via the bearing pivotal tangential contact 230 to operationally help the friction head 145 to resist the free ends 70, 325 of the article 55, 300 from going in a removal direction 57, 310 however, also operationally the free ends 70, 325 of the article 55, 300 when being manually fed therethrough the surrounding sidewall interior 105, 360 in the putting on direction 56, 305 of the article 55, 300 can overcome the bias to move 260 the first plane 146 to be substantially parallel 270 to the longitudinal axis 80, 335, see FIGS. 7, 8, 9, 18, 19, and 20.

A further option for the article retention apparatus 50 is wherein the ornamental element 140 first weight is greater than or equal to fifty times a second weight of the friction head 145 to ensure that the bias resulting in the first free movement 260 overcomes a frictional resistance of the flexible element 120 as against the aperture 110, 365, see FIGS. 2, 3, 4, 11, 12, 13, and 14.

Next alternatively for the article retention apparatus 50 is wherein the friction head 145 further includes a pair of said second radii 220 terminating in a pair of the second surfaces 240, wherein the second surfaces 240 each straddle the flexible element 120 thus suspending the friction head 145 over the aperture 110, 365 in a pair of bearing pivotal tangential contacts 231 as against the surrounding sidewall inner surface 100, 355, resulting in the first free movement 260 being more balanced via having two symmetric bearing pivotal tangential contacts 231 on the friction head 145 about the flexible element 120 and suspended over the aperture 110, 365 as against the surrounding sidewall inner surface 100, 355, see FIGS. 3, 4, 7, 8, 9, 12, 13, 14, 18, 19, and 20.

Further alternatively, for the article retention apparatus 50 is wherein the friction head 145 can further include a third distance 225 going from the projection surface 250 and terminating in a third surface 226 that is disposed in-between the pair of second surfaces 240, wherein the third distance 225 is less than the first radius 210, wherein operationally the third surface 226 creates a third free space 227 disposed as between the pair of bearing pivotal tangential contacts 230 as against the surrounding sidewall inner surface 100, 355 and further defined by the third surface 226 resulting in a more friction free first free movement 260 of the friction head 145 as the friction head 145 is suspended over the aperture 110, 365, see FIGS. 3, 4, 7, 8, 9, 12, 13, 14, 18, 19, and 20.

A further option for the article retention apparatus 50 is wherein the flexible element 120 proximal end portion 125 is affixed 150 to the friction head 145 between the pair of the second surfaces 240 to operationally help ensure the first free movement 260, see FIGS. 3, 4, 12, 13, and 14.

Also another option for the article retention apparatus 50 can further comprise a plurality 170 of flexible elements 120 such that each flexible element 120 has a proximal end portion 125 that are each affixed 150 to the friction head 145 with each proximal end portion 125 affixment 150 being disposed between the pair of the second surfaces 240, wherein each flexible element 120 distal end portion 130 has a separate ornamental element 140 affixed thereto such that the sum of the plurality of the ornamental elements 140 equals a first plurality ornamental weight that is greater than a second weight of the friction head 145. This is to operationally bias the friction head 145 to create the first free movement 260, such that the friction head 145 is moving the first plane 146 from being substantially parallel 270 to the longitudinal axis 80, 335 to being substantially perpendicular 280 to the longitudinal axis 80, 335 via the pair of bearing pivotal tangential contacts 230 to operationally help the friction head 145 to resist the free ends 70, 325 of the article 55, 300, from going in a removal direction 57, 310, however also operationally the free ends 70, 325 of the article 55, 300 when being manually fed therethrough the surrounding sidewall interior 105, 360 in the putting on direction 56, 305 of the article 55, 300 can overcome the bias to move the first plane 146 to be substantially parallel 270 to the longitudinal axis 80, 335, see FIGS. 3, 4, 7, 8, 9, 12, 13, 14, 18, 19, and 20.

A continuing option for the article retention apparatus 50 is wherein the first plurality 170 ornamental weights 140 including flexible elements 120 summed is greater than or equal to fifty times the second weight of the friction head 145 to ensure that the bias resulting in the first free movement 260 overcomes a frictional resistance of the plurality 170 of flexible elements 120 as against the aperture 110, 365 and via having the two symmetric bearing pivotal tangential contacts 230, 231 on the friction head 145 as against the surrounding sidewall inner surface 100, 355 about the flexible element 120 and suspended over the aperture 110, 365, see FIGS. 3, 4, 7, 8, 9, 12, 13, 14, 18, 19, and 20.

Another option for the article retention apparatus 50, is wherein the second radius 220 being less than the first radius 210 results in the bearing pivotal tangential contact 230 that has movement 231 along the surrounding sidewall inner surface 100, 355 about the longitudinal axis 80, 335 simultaneous with the friction head 145 to create a first free movement 260, such that the friction head 145 is planar forming the first plane 146 and the first plane 146 is moving in the first free movement 260 from being substantially parallel 270 to the longitudinal axis 80, 335 to being substantially perpendicular 280 to the longitudinal axis 80, 335 via the moving bearing pivotal tangential contact 231 along the surrounding sidewall inner surface 100, 355, such that a third free space area 227 is formed between the friction head 145 and the surrounding sidewall inner surface 100, 355 adjacent to the aperture 110, 365.

This resulting in the third free space area 227 being minimized and the moving bearing pivotal tangential contact 231 is moved toward the aperture 110, 365 when the first plane 146 is perpendicular 280 to the longitudinal axis 80, 335 and conversely the third free space area 227 is maximized and the moving bearing pivotal tangential contact 231 is moved away from the aperture 110, 365 when the first plane 146 is parallel 270 to the longitudinal axis 80, 335. This results that the friction head 145 has greater mechanical advantage, as the projection distance 200 from the moving pivotal tangential contact 231 results in the projection distance 200 decreasing in moving from what is shown in FIGS. 8, 19 to FIGS. 7, 18 respectively, such that the article 55, 300 being compressed 165, 375 to a greater extent due to the third free space 227 reducing, as opposed to a fixed pivot between the friction head 145 to the surrounding sidewall 75, 330 inner surface 100, 355, that would maintain the projection distance as a constant, so the moving tangent contact point 231 causes the third free space 227 change as defined above, see FIGS. 3, 4, 7, 8, 9, 12, 13, 14, 18, 19, and 20.

A further option for the article retention apparatus 50, is wherein the pair of second radii 220 being less than the first radius 210 to cause the pair of definite contacts 230 to become a pair of bearing pivotal tangential contacts 231 that have movement along the surrounding sidewall inner surface 100, 355 about the longitudinal axis 80, 335 simultaneous with the friction head 145 to create the first free movement 260, such that the friction head 145 is planar forming the first plane 146 and the first plane 146 is moving in the first free movement 260 from being substantially parallel 270 to the longitudinal axis 80, 335 to being substantially perpendicular 280 to the longitudinal axis 80, 335 via the pair of moving bearing pivotal tangential contacts 231, such that the third free space area 227 is formed between the friction head 145 and the surrounding sidewall inner surface 100, 355 adjacent to the aperture 110, 365.

Wherein the third free space area 227 is minimized and the pair of moving bearing pivotal tangential contacts 231 being both moved toward the aperture 110, 365 from opposite directions when the first plane 146 is perpendicular 280 to the longitudinal axis 80, 335 and conversely the third free space area 227 is maximized and the pair of moving bearing pivotal tangential contacts 231 are moved away from the aperture 110, 365 in opposite directions when the first plane 146 is parallel 270 to the longitudinal axis 80, 335 resulting in the first weight only creating the first free movement 260 in going from the first plane 146 being parallel 270 to the longitudinal axis 80, 335 to the first plane 146 going to being perpendicular 280 to the longitudinal axis 80, 335 and not any further movement 260, see FIGS. 3, 4, 7, 8, 9, 12, 13, 14, 18, 19, and 20. Further, the friction head 145 can operationally retain the flexible element 120 within the aperture 110, 365 of the article retention apparatus 50 without compressing 165, 375 the article 55, 300, see FIGS. 21 to 25.

CONCLUSION

Accordingly, the present invention of an article retention apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. An article retention apparatus adapted to retain the article in a loop, wherein the article is in an elongated shape having two free ends, said article retention apparatus comprising:

(a) a surrounding sidewall about a longitudinal axis, said surrounding sidewall having a first end portion and an opposing second end portion with said longitudinal axis spanning therebetween, said surrounding sidewall having an outer surface and an opposing inner surface that defines a surrounding sidewall interior;

(b) an aperture disposed therethrough said surrounding sidewall from said outer surface to said inner surface, said aperture having an aperture largest dimension;

(c) a flexible element having a proximal end portion and an opposing distal end portion, wherein said flexible element is partially disposed therethrough said aperture, said flexible element is positioned such that said flexible element proximal end portion is disposed within said surrounding sidewall interior and said flexible element distal end portion is adjacent to said surrounding sidewall outer surface;

(d) an ornamental element affixed to said flexible element distal end portion; and (e) a friction head affixed to said flexible element proximal end portion, said friction head having a maximum dimension that is greater than said aperture largest dimension, said friction head projects into said surrounding sidewall interior, further said friction head is substantially planar forming a first plane, and operationally accomplishes two functions, a first function is to retain said flexible element within said aperture and a second function is to compress the two free ends of the article that are threaded therethrough said interior of said surrounding sidewall to add friction to the free ends of the article to further help retain the article two free ends to be adjacent to one another via said article retention apparatus.

2. The article retention apparatus according to claim 1 further comprising a plurality of flexible elements that each have a proximal end portion that are each affixed to said friction head, wherein each said flexible element distal end portion has a separate ornamental element affixed thereto.

3. The article retention apparatus according to claim 1 wherein when said friction head projects into said surrounding sidewall interior, it is at a projection distance that is equal to or greater than a first radius going from said longitudinal axis to said surrounding sidewall inner surface, wherein said projection distance terminates in a projection surface to operationally further compress the two free ends of the article that are threaded therethrough said interior of said surrounding sidewall to add friction to the free ends of the article to further help retain the article two free ends to be adjacent to one another via said article retention apparatus.

4. The article retention apparatus according to claim 3 wherein said friction head further comprises a second radius terminating in a second surface, wherein said second radius is less than said first radius, wherein said second surface has a bearing pivotal tangential contact to a portion of said surrounding sidewall inner surface, to operationally give said friction head a definite contact to said surrounding sidewall inner surface adjacent to said aperture.

5. The article retention apparatus according to claim 4 wherein said ornamental element has a first weight that is greater than a second weight of said friction head to operationally bias said friction head to create a first free movement, such that said friction head is moving said first plane from being substantially parallel to said longitudinal axis to being substantially perpendicular to said longitudinal axis via said bearing pivotal tangential contact to operationally help said friction head to resist the free ends of the article from going in a removal direction, however also operationally the free ends of the article when being manually fed therethrough said surrounding sidewall interior in the putting on direction of the article can overcome said bias to move said first plane to be substantially parallel to said longitudinal axis.

6. The article retention apparatus according to claim 5 wherein said ornamental element first weight is greater than or equal to fifty times a second weight of said friction head to ensure that said bias resulting in said first free movement overcomes a frictional resistance of said flexible element as against said aperture.

7. The article retention apparatus according to claim 5 wherein said friction head further includes a pair of said second radii terminating in a pair of said second surfaces, wherein said second surfaces each straddle said flexible element thus suspending said friction head over said aperture in a pair of bearing pivotal tangential contacts as against said surrounding sidewall inner surface, resulting in said first free movement being more balanced via having two symmetric bearing pivotal tangential contacts on said friction head about said flexible element and suspended over said aperture as against said surrounding sidewall inner surface.

8. The article retention apparatus according to claim 7 wherein said friction head further includes a third distance going from said projection surface and terminating in a third surface that is disposed in-between said pair of second surfaces, wherein said third distance is less than said first radius, wherein operationally said third surface creates a third free space disposed as between said pair of bearing pivotal tangential contacts as against said surrounding sidewall inner surface and further defined by said third surface resulting in a more friction free first free movement of said friction head as said friction head is suspended over said aperture.

9. The article retention apparatus according to claim 8 wherein said flexible element proximal end portion affixed to said friction head is to be affixed to said friction head between said pair of said second surfaces to operationally help ensure said first free movement.

10. The article retention apparatus according to claim 9 further comprising a plurality of flexible elements such that each flexible element has a proximal end portion that are each affixed to said friction head with each proximal end portion affixment being disposed between said pair of said second surfaces, wherein each said flexible element distal end portion has a separate ornamental element affixed thereto such that the sum of said plurality of said ornamental elements equals a first plurality ornamental weight that is greater than a second weight of said friction head, to operationally bias said friction head to create said first free movement, such that said friction head is moving said first plane from being substantially parallel to said longitudinal axis to being substantially perpendicular to said longitudinal axis via said pair of bearing pivotal tangential contacts to operationally help said friction head to resist the free ends of the article from going in a removal direction, however also operationally the free ends of the article when being manually fed therethrough said surrounding sidewall interior in the putting on direction of the article can overcome said bias to move said first plane to be substantially parallel to said longitudinal axis.

11. The article retention apparatus according to claim 10 wherein said first plurality ornamental weights summed is greater than or equal to fifty times said second weight of said friction head to ensure that said bias resulting in said first free movement overcomes a frictional resistance of said plurality of flexible elements as against said aperture and via having said two symmetric bearing pivotal tangential contacts on said friction head as against said surrounding sidewall inner surface about said flexible element and suspended over said aperture.

12. The article retention apparatus according to claim 4 wherein said second radius being less than said first radius results in said bearing pivotal tangential contact that has movement along said surrounding sidewall inner surface about said longitudinal axis simultaneous with said friction head to create a first free movement, such that said friction head is planar forming said first plane and said first plane is moving in a first free movement from being substantially parallel to said longitudinal axis to being substantially perpendicular to said longitudinal axis via said moving bearing pivotal tangential contact along said surrounding sidewall inner surface, such that a third free space area is formed between said friction head and said surrounding sidewall inner surface adjacent to said aperture, such that said third free space area is minimized and said moving bearing pivotal tangential contact is moved toward said aperture when said first plane is perpendicular to said longitudinal axis and conversely said third free space area is maximized and said moving bearing pivotal tangential contact is moved away from said aperture when said first plane is parallel to said longitudinal axis.

13. The article retention apparatus according to claim 7 wherein said pair of second radii being less than said first radius to cause said pair of definite contacts to become a pair of bearing pivotal tangential contacts that have movement along said surrounding sidewall inner surface about said longitudinal axis simultaneous with said friction head to create a first free movement, such that said friction head is planar forming said first plane and said first plane is moving in said first free movement from being substantially parallel to said longitudinal axis to being substantially perpendicular to said longitudinal axis via said pair of moving bearing pivotal tangential contacts, such that a third free space area is formed between said friction head and said surrounding sidewall inner surface adjacent to said aperture, such that said third free space area is minimized and said pair of moving bearing pivotal tangential contacts being both moved toward said aperture from opposite directions when said first plane is perpendicular to said longitudinal axis and conversely said third free space area is maximized and said pair of moving bearing pivotal tangential contacts are moved away from said aperture in opposite directions when said first plane is parallel to said longitudinal axis, resulting in said first weight only creating said first free movement in going from said first plane being parallel to said longitudinal axis to said first plane going to being perpendicular to said longitudinal axis and not any further.

14. An article retention apparatus adapted to retain the article in a loop, wherein the article is in an elongated shape having two free ends, said article retention apparatus comprising:

(a) a surrounding sidewall about a longitudinal axis, said surrounding sidewall having a first end portion and an opposing second end portion with said longitudinal axis spanning therebetween, said surrounding sidewall having an outer surface and an opposing inner surface that defines a surrounding sidewall interior;

(b) an aperture disposed therethrough said surrounding sidewall from said outer surface to said inner surface, said aperture having an aperture largest dimension;

(c) a flexible element having a proximal end portion and an opposing distal end portion, wherein said flexible element is partially disposed therethrough said aperture, said flexible element is positioned such that said flexible element proximal end portion is disposed within said surrounding sidewall interior and said flexible element distal end portion is adjacent to said surrounding sidewall outer surface;

(d) an ornamental element affixed to said flexible element distal end portion; and (e) a friction head affixed to said flexible element proximal end portion, said friction head having a maximum dimension that is greater than said aperture largest dimension, said friction head projects into said surrounding sidewall interior, further said friction head is substantially planar forming a first plane, said friction head operationally retains said flexible element within said aperture of said article retention apparatus.

* * * * *